US011351692B2

(12) United States Patent
Kosuge

(10) Patent No.: US 11,351,692 B2
(45) Date of Patent: Jun. 7, 2022

(54) TAPE DETECTION MECHANISM AND TAPE PRINTING APPARATUS

(71) Applicant: SEIKO EPSON CORPORATION, Tokyo (JP)

(72) Inventor: Shinsaku Kosuge, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 162 days.

(21) Appl. No.: 16/828,827

(22) Filed: Mar. 24, 2020

(65) Prior Publication Data

US 2020/0307011 A1 Oct. 1, 2020

(30) Foreign Application Priority Data

Mar. 25, 2019 (JP) ..... JP2019-057194

(51) Int. Cl.

| | |
|---|---|
| ***B41J 3/407*** | (2006.01) |
| ***B41J 11/00*** | (2006.01) |
| ***B26D 5/30*** | (2006.01) |
| ***B26D 1/09*** | (2006.01) |

(52) U.S. Cl.
CPC ..... *B26D 5/30* (2013.01); *B26D 1/095* (2013.01); *B41J 3/4075* (2013.01)

(58) Field of Classification Search
CPC ..... B41J 3/4075; B41J 11/0095; B65H 7/02; G03G 2215/00616; G03G 2215/00628
See application file for complete search history.

(56) References Cited

U.S. PATENT DOCUMENTS 5,882,130 A * 3/1999 Kumazaki ..... B65H 7/02 400/642
2013/0195535 A1 8/2013 Kosuge et al.
2016/0272447 A1* 9/2016 Koyama ..... B65H 5/062

FOREIGN PATENT DOCUMENTS

JP 2006264313 A * 10/2006
JP 2013-159409 A 8/2013

* cited by examiner

*Primary Examiner* — Daniel J Colilla
(74) *Attorney, Agent, or Firm* — Oliff PLC

(57) ABSTRACT

A tape detection mechanism including a first pivoting member provided to pivot about a detection pivoting shaft, a second pivoting member linked, to be configured to pivot, to a pivot linking portion provided on the first pivoting member, a pivoting contact section with which the second pivoting member comes into contact when the first pivoting member and the second pivoting member pivot in a first pivoting direction about the detection pivoting shaft as the tape, which is fed thereto, comes into contact with the first pivoting member, and a sensor which detects the second pivoting member which comes into contact with the pivoting contact section.

5 Claims, 19 Drawing Sheets

TAPE DETECTION MECHANISM AND TAPE PRINTING APPARATUS

The present application is based on, and claims priority from JP Application Serial Number 2019-057194, filed Mar. 25, 2019, the disclosure of which is hereby incorporated by reference herein in its entirety.

BACKGROUND

1. Technical Field

The present disclosure relates to a tape detection mechanism which detects a tape which is fed thereto and a tape printing apparatus.

2. Related Art

In the related art, as disclosed in JP-A-2013-159409, there is known a tape printing apparatus provided with a tape detection mechanism which detects a tape which is fed thereto. The tape detection mechanism is provided with a rotating body slider which slides due to the tape which is fed thereto, a rotating member which pivots due to the rotating body slider sliding, a detection arm which extends in radial directions of the rotation member, and a slider detector which detects the leading end portion of the detection arm. Since the pivoting amount of the leading end portion of the detection arm is great in relation to the disposition amount of the rotating body slider, even when the thickness of the tape, which is fed thereto, is thin, the leading end portion of the detection arm is appropriately detected by the slider detector.

In the tape detection mechanism of the related art, when the thickness of the tape which is fed is thick, since the pivoting amount of the detection arm increases by a corresponding amount, the tape detection mechanism increases in size in order to secure the space for the detection arm to pivot.

SUMMARY

According to an aspect of the present disclosure, there is provided a tape detection mechanism including a first pivoting member provided to pivot about a detection pivoting shaft, a second pivoting member pivotally linked to a pivot linking portion provided on the first pivoting member, a pivoting contact section with which the second pivoting member comes into contact when the first pivoting member and the second pivoting member pivot in a first pivoting direction about the detection pivoting shaft as the tape, which is fed thereto, comes into contact with the first pivoting member, and a sensor which detects the second pivoting member which comes into contact with the pivoting contact section.

According to another aspect of the present disclosure, there is provided a tape printing apparatus including a first pivoting member provided to pivot about a detection pivoting shaft, a second pivoting member pivotally linked to a pivot linking portion provided on the first pivoting member, a pivoting contact section with which the second pivoting member comes into contact when the first pivoting member and the second pivoting member pivot in a first pivoting direction about the detection pivoting shaft as the tape, which is fed thereto, comes into contact with the first pivoting member, a sensor which detects the second pivoting member which comes into contact with the pivoting contact section, and a print head which performs printing on the tape.

DESCRIPTION OF EXEMPLARY EMBODIMENTS

Hereinafter, a description will be given of an embodiment of the tape printing apparatus with reference to the accompanying drawings. Although an XYZ Cartesian coordinate system is displayed in the following drawings, this is merely for the convenience of explanation and is not intended to limit the following embodiment in any manner. Numerical values indicating the number of each part or the like are all merely exemplary and are not intended to limit the following embodiment in any manner.

Outline of Tape Printing Apparatus

Figure 1:
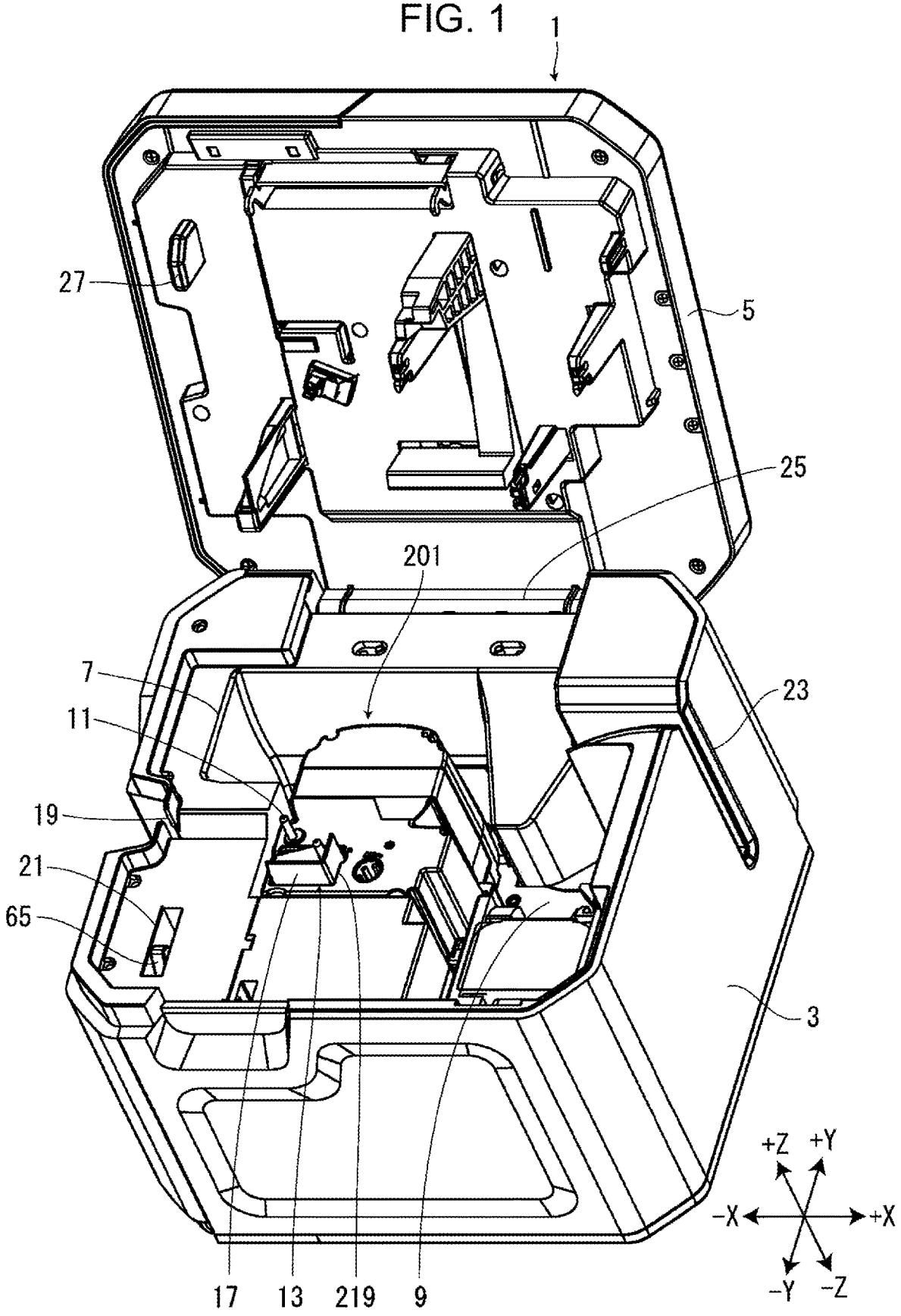
FIG. 1 is a perspective view of a tape printing apparatus in a state in which a mounting portion cover is opened.

As illustrated in FIG. 1, a tape printing apparatus 1 is provided with an apparatus case 3 and a mounting portion cover 5. The apparatus case 3 is formed in a substantially rectangular parallelepiped shape. A cartridge mounting portion 7 is provided on the surface of the +Z side of the apparatus case 3.

A tape cartridge 201 is mounted to the cartridge mounting portion 7 in an attachable/detachable manner. The cartridge mounting portion 7 is formed in a recessed shape in which the +Z side is open. A platen shaft 11 and a head section 13 are provided to protrude to the +Z side on a mounting base surface 9 which is a base surface, that is, a surface of the −Z side of the cartridge mounting portion 7.

When the tape cartridge 201 is mounted to the cartridge mounting portion 7, the platen shaft 11 is inserted through a platen roller 205 (refer to FIG. 3) and guides the mounting of the tape cartridge 201. The head section 13 is positioned of the −Y side of the platen shaft 11. The head section 13 is provided with a print head 15 (refer to FIG. 17) and a head cover 17 which covers at least the +X side, the −Y side, and the +Z side of the print head 15. The print head 15 is a thermal head provided with a heater element. When the tape cartridge 201 is mounted to the cartridge mounting portion 7, the head cover 17 is inserted through a head insertion hole 219 and guides the mounting of the tape cartridge 201. When the mounting portion cover 5 is closed in a state in which the tape cartridge 201 is mounted to the cartridge mounting portion 7, the print head 15 moves toward the platen shaft 11 due to a head movement mechanism (not illustrated). Accordingly, a tape 213 and an ink ribbon 217 are pinched between the print head 15 and the platen roller 205. The tape printing apparatus 1 prints print information input from a keyboard or the like onto the tape 213 by causing the print head 15 to generate heat while feeding the tape 213 and the ink ribbon 217 by rotating the platen roller 205.

Figure 2:
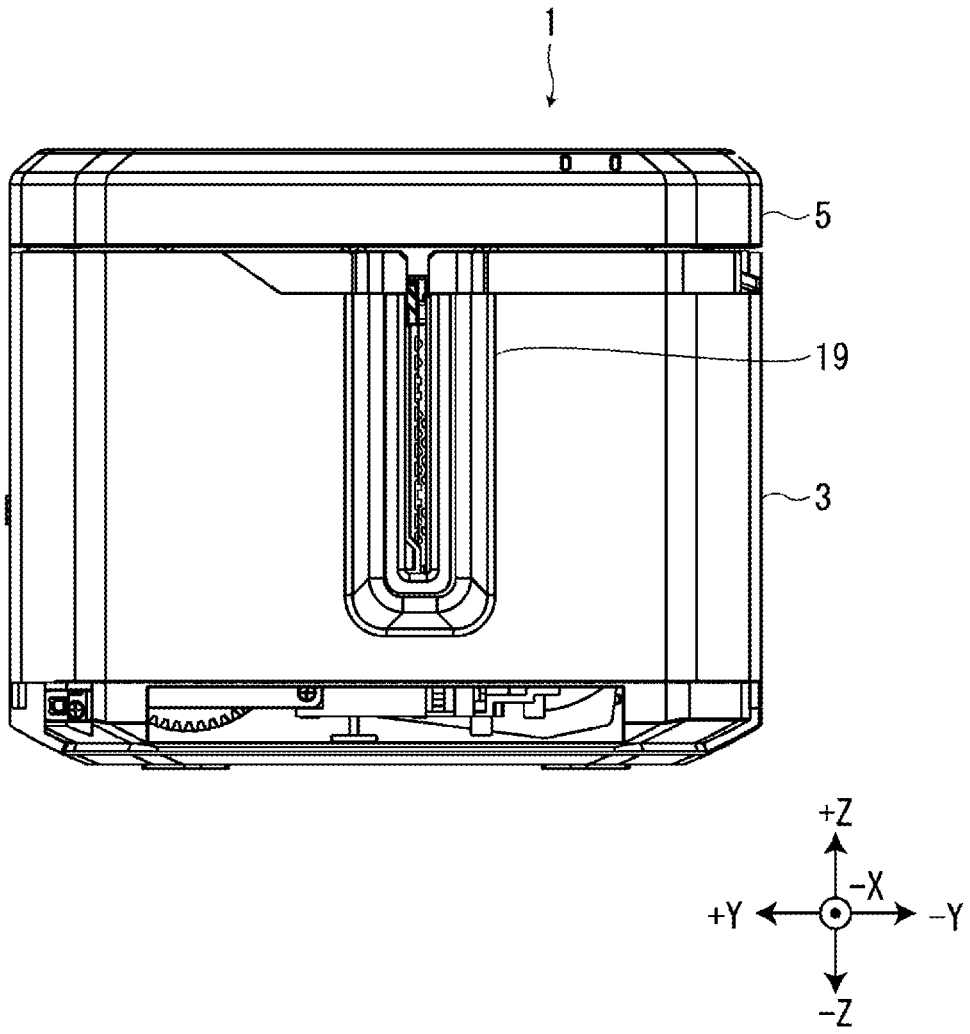
FIG. 2 is a view of the tape printing apparatus in a state in which the mounting portion cover is closed as viewed from a −X side.

A tape discharge port 19 is provided in a surface of the −X side of the apparatus case 3. The tape 213 (refer to FIG. 3) dispensed from the tape cartridge 201 mounted to the cartridge mounting portion 7 is discharge from the tape discharge port 19. The tape output port 19 is formed in a slit shape extending in the Z direction (refer to FIG. 2). A full cutter 155, a half cutter 157, and a tape discharge unit 33 (refer to FIG. 17) are embedded between the cartridge mounting portion 7 and the tape discharge port 19.

A substantially rectangular interlocking opening 21 which is long in the Y direction is provided in the surface of the +Z side of the apparatus case 3 in the vicinity of the corner portion of the −X side and the −Y side. An interlocking lever 65 (described later) is provided inside the interlocking opening 21.

It is possible to mount a ribbon cartridge (not illustrated) to the cartridge mounting portion 7 in an attachable/detachable manner instead of the tape cartridge 201. When the ribbon cartridge is mounted to the cartridge mounting portion 7, the tape is introduced from a tape introduction port 23 provided in a surface of the +X side of the apparatus case 3.

The mounting portion cover 5 opens and closes the cartridge mounting portion 7. The mounting portion cover 5 is attached to the apparatus case 3 to be capable of pivoting about a hinge portion 25 provided on the end portion of the +Y side of the mounting portion cover 5. An interlocking protrusion 27 is provided on the inside surface of the mounting portion cover 5. When the mounting portion cover 5 is closed, the interlocking protrusion 27 proceeds into the interlocking opening 21 and engages with the interlocking lever 65. A keyboard 29 and a display 31 are provided in the inner portion of the mounting portion cover 5 (refer to FIG. 17). The keyboard 29 receives input operations of print information such as character strings and various instructions such as print execution. The display 31 displays various information in addition to the print information input from the keyboard 29.

Tape Cartridge

Figure 3:
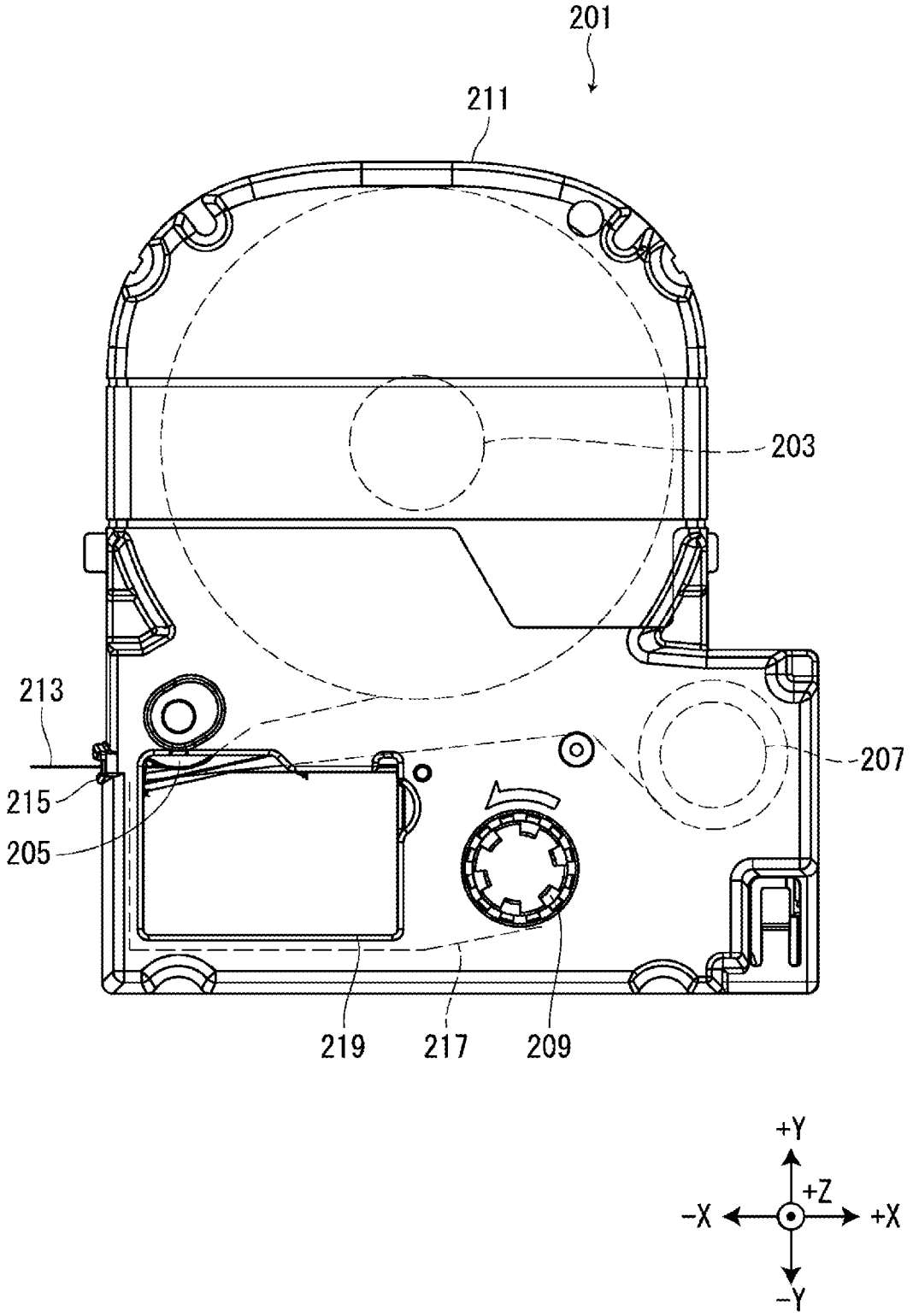
FIG. 3 is a view of a tape cartridge from a +Z side.

As illustrated in FIG. 3, the tape cartridge 201 is provided with a tape core 203, the platen roller 205, a dispensing core 207, a winding core 209, and a cartridge case 211.

Figure 18:
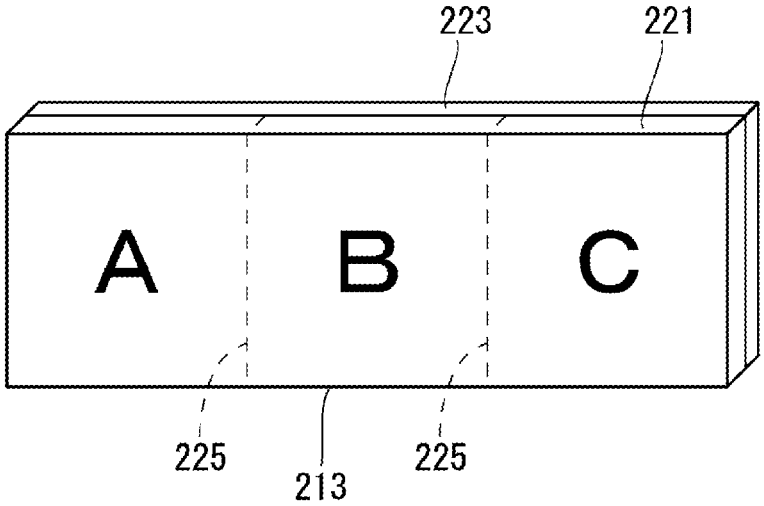
FIG. 18 is a view illustrating a tape in which a cut is formed in a printing tape by a half cutter.

The tape 213 is wound around the tape core 203. The tape 213 dispensed from the tape core 203 is fed to the outside of the cartridge case 211 from a tape feed-out port 215 provided on a peripheral wall portion of the −X side of the cartridge case 211. The ink ribbon 217 is wound around the dispensing core 207. The ink ribbon 217 dispensed from the dispensing core 207 is wound onto the winding core 209. The cartridge case 211 configures an outer shell of the tape cartridge 201 and stores the tape core 203, the platen roller 205, the dispensing core 207, the winding core 209, a printing tape 221, and the ink ribbon 217. The head insertion hole 219 is provided to penetrate the cartridge case 211 in the Z directions. The tape 213 is provided with the printing tape 221 on which the printing is performed by the print head 15 and a peeling tape 223 which is bonded to the adhesive surface of the printing tape 221 to be capable of being peeled (refer to FIG. 18).

Tape Output Unit

Figure 4:
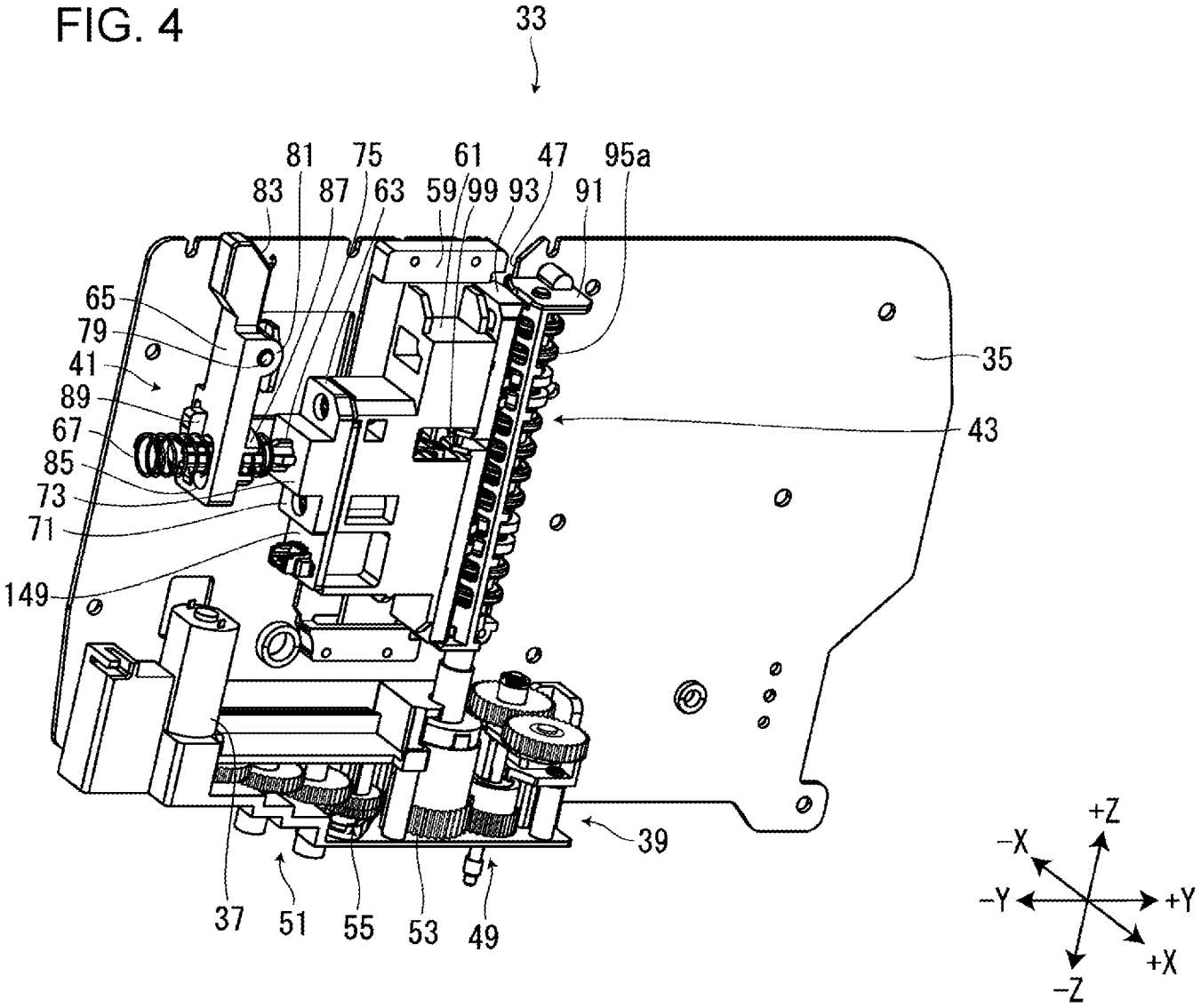
FIG. 4 is a perspective diagram of a tape discharge unit.
Figure 5:
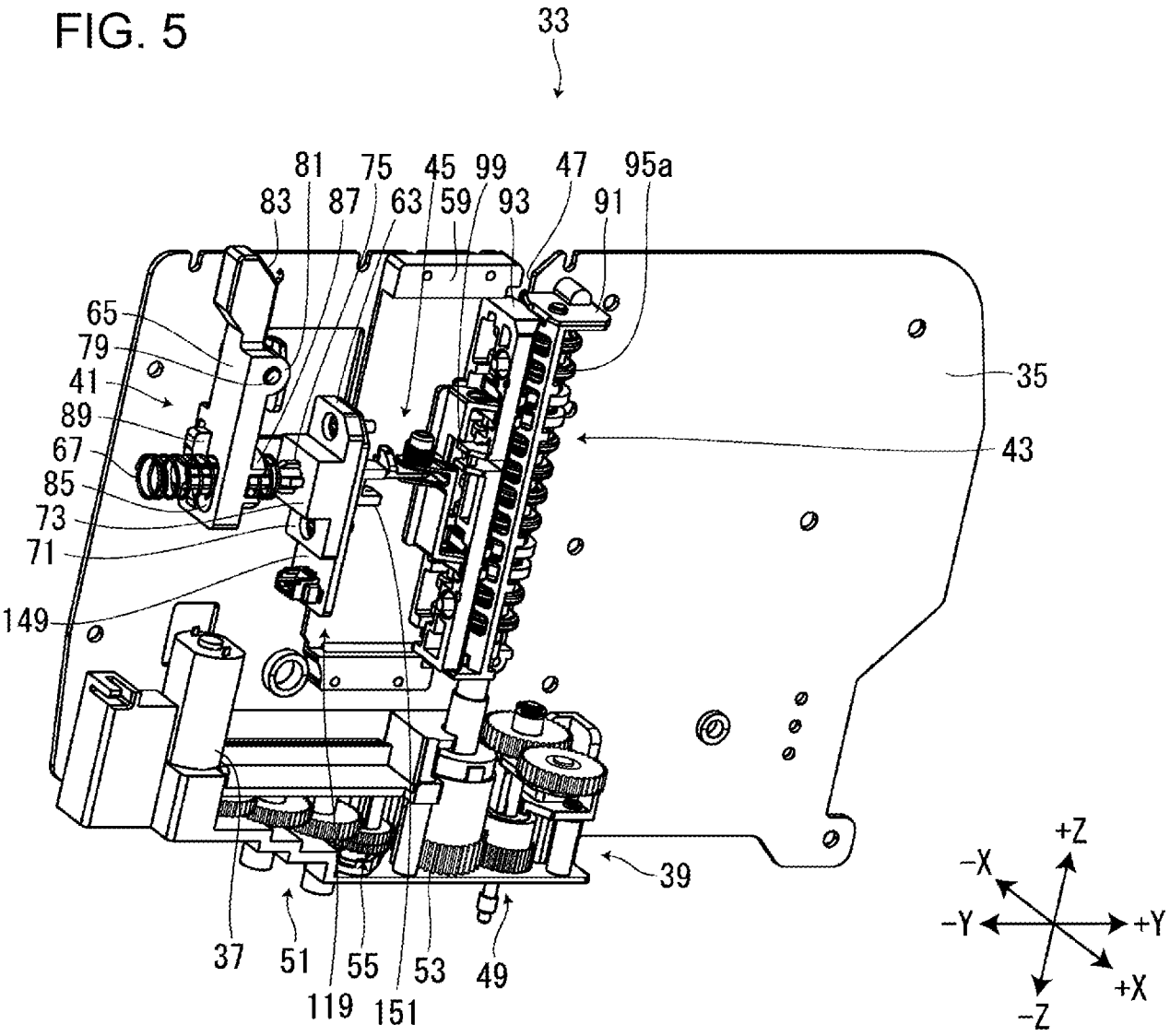
FIG. 5 is a perspective diagram of the tape discharge unit with a sliding member removed.

As illustrated in FIGS. 4 and 5, the tape discharge unit 33 is provided with an discharge frame 35, an discharge motor 37, an discharge gear train 39, an interlocking mechanism 41, an discharge feeding section 43, and a tape detection mechanism 45.

The discharge frame 35 is formed in a substantially rectangular plate-shape which is long in the Y directions. The parts of the tape discharge unit 33 are attached to the surface of the +X side of the discharge frame 35. A slit-shaped tape passage port 47, which is cut into the discharge frame 35 from the end portion of the +Z side to the −Z side, is formed in a substantially middle portion of the discharge frame 35 in the Y directions. The tape passage port 47 is located where the tape 213 fed from the tape feed-out port 215 of the tape cartridge 201 mounted in the cartridge mounting portion 7 to the tape discharge port 19 passes through.

The discharge motor 37 is provided in the vicinity of the corner portion of the −Y size and the −Z side of the apparatus frame. The discharge motor 37 serves as the drive source of a first discharge roller **95*a* (described later). As described later, the first discharge roller 95*a* includes a case in which the discharge motor 37 is used as the drive source and a case in which a feed motor 153 (refer to FIG. 17) which drives the platen roller 205** is used as the drive source.

The discharge gear train 39 is provided on the end portion of the −Z side of the discharge frame 35. The discharge gear train 39 is provided with a feed motor-side gear train 49, an discharge motor-side gear train 51, and a clutch mechanism 55. The feed motor-side gear train 49 transmits the rotation of the feed motor 153 input via a feed gear train (not illustrated) to the first discharge roller **95*a*. The discharge motor-side gear train 51 transmits the rotation input thereto from the discharge motor 37 to the first discharge roller 95*a***.

The clutch mechanism 55 is provided between the discharge motor-side gear train 51 and a roller gear 53 provided on the same shaft as the first discharge roller **95*a*. The clutch mechanism 55 switches between a state in which the clutch mechanism 55 transmits the rotation between the discharge motor-side gear train 51 and the roller gear 53 and a state in which the clutch mechanism 55 cuts off the transmission between the discharge motor-side gear train 51 and the roller gear 53. The clutch mechanism 55 is provided with a clutch gear 57 (refer to FIG. 6) configured to be capable of engaging and disengaging with respect to the roller gear 53**.

When the discharge motor 37 rotates, the clutch gear 57 meshes with the roller gear 53 and the rotation of the discharge motor 37 is transmitted between the discharge motor-side gear train 51 and the roller gear 53. Accordingly, the first discharge roller 95*a* rotates using the discharge motor 37 as the drive source. On the other hand, when the feed motor 153 rotates, the clutch gear 57 disconnects from the roller gear 53 and the transmission of the rotation of the feed motor 153 between the discharge motor-side gear train 51 and the roller gear 53 is cut off. Accordingly, the first discharge roller 95*a* rotates using the feed motor 153 as the drive source.

As illustrated in FIGS. 6 to 9, the interlocking mechanism 41 works together with the opening and closing operations of the mounting portion cover 5 to cause a second discharge roller 95*b* and third discharge rollers 95*c* supported by a movable holder 93 (described later) to approach and distance with respect to the first discharge roller 95*a*. In other words, when the mounting portion cover 5 is closed, the interlocking mechanism 41 causes the movable holder 93 to move to the +Y side and causes the second discharge roller 95*b* and the third discharge rollers 95*c* to approach the first discharge roller 95*a*. On the other hand, when the mounting portion cover 5 is opened, the interlocking mechanism 41 causes the movable holder 93 to move to the −Y side and causes the second discharge roller 95*b* and the third discharge rollers 95*c* to distance from the first discharge roller 95*a*. The interlocking mechanism 41 is provided with a slide support portion 59, a sliding member 61, an interlocking block 63, the interlocking lever 65, and a pinching spring 67.

The slide support portion 59 is fixed to the −Y side of the tape passage port 47. The sliding member 61 is supported by the slide support portion 59 to be capable of sliding in the Y directions. The movable holder 93 is fixed to the +Y side of the sliding member 61. A pivoting contact section 69 (refer to FIG. 15) with which a second pivoting member 123 (described later) comes into contact is provided on the wall portion of the +X side of the sliding member 61. Here, "contact" indicates touching in an abutting state.

The interlocking block 63 is fixed to the −Y side of the sliding member 61 via a sensor substrate 149 (described later). The interlocking block 63 is provided with a large block portion 71 attached to the sliding member 61, a small block portion 73 provided of the −Y side of the large block portion 71, and a rod portion 75 protruding to the −Y side from the small block portion 73. A rod-side engaging portion 77 (refer to FIG. 16) which engages with a lever-side engaging portion 89 (described later) is provided of the −X side of the leading end portion of the rod portion 75.

The interlocking lever 65 is provided to be capable of pivoting on a lever shaft 79 fixed to the discharge frame 35. The interlocking lever 65 extends in the Z directions and is provided with a lever shaft insertion portion 81, a lever-side engaging inclined surface 83, a rod insertion hole 85, a lever-side protruding portion 87, and the lever-side engaging portion 89.

The lever shaft insertion portion 81 is provided at substantially the middle portion of the interlocking lever 65 in the Z directions. The lever shaft 79 is inserted through the lever shaft insertion portion 81. The lever-side engaging inclined surface 83 is provided of the +Y side of the end portion of the interlocking lever 65 of the +Z side. When the mounting portion cover 5 is closed, the lever-side engaging inclined surface 83 engages with the interlocking protrusion 27 which enters from the interlocking opening 21. The rod insertion hole 85 is provided on the end portion of the interlocking lever 65 of the −Z side. The rod insertion hole 85 is formed in a substantially elliptical shape which is long in the Z directions and penetrates the interlocking lever 65 in the Y directions. The rod portion 75 is inserted through the rod insertion hole 85. The lever-side protruding portion 87 is provided on an opening edge portion of the rod insertion hole 85 of the +Y side. The lever-side protruding portion 87 engages with the end portion of the pinching spring 67 of the −Y side. The lever-side engaging portion 89 is provided of the −X side of the opening edge portion of the rod insertion hole 85 of the −Y side. The lever-side engaging portion 89 engages with the rod-side engaging portion 77. In FIG. 4 and the like, a state of the pinching spring 67 is depicted in which the engagement with the lever-side protruding portion 87 is disconnected and the pinching spring 67 is extended to a maximum extent to the −Y side. In other words, when the pinching spring 67 engages with the lever-side protruding portion 87, the pinching spring 67 is compressed in the Y directions and applies a pushing force to the interlocking block 63 and the interlocking lever 65.

The pinching spring 67 is provided between the small block portion 73 and the lever-side protruding portion 87 to fit onto the rod portion 75. The pinching spring 67 applies a force to the interlocking block 63 in the +Y direction when the interlocking lever 65 is considered to be fixed. For example, it is possible to use a compressed coil spring as the pinching spring 67.

Figure 6:
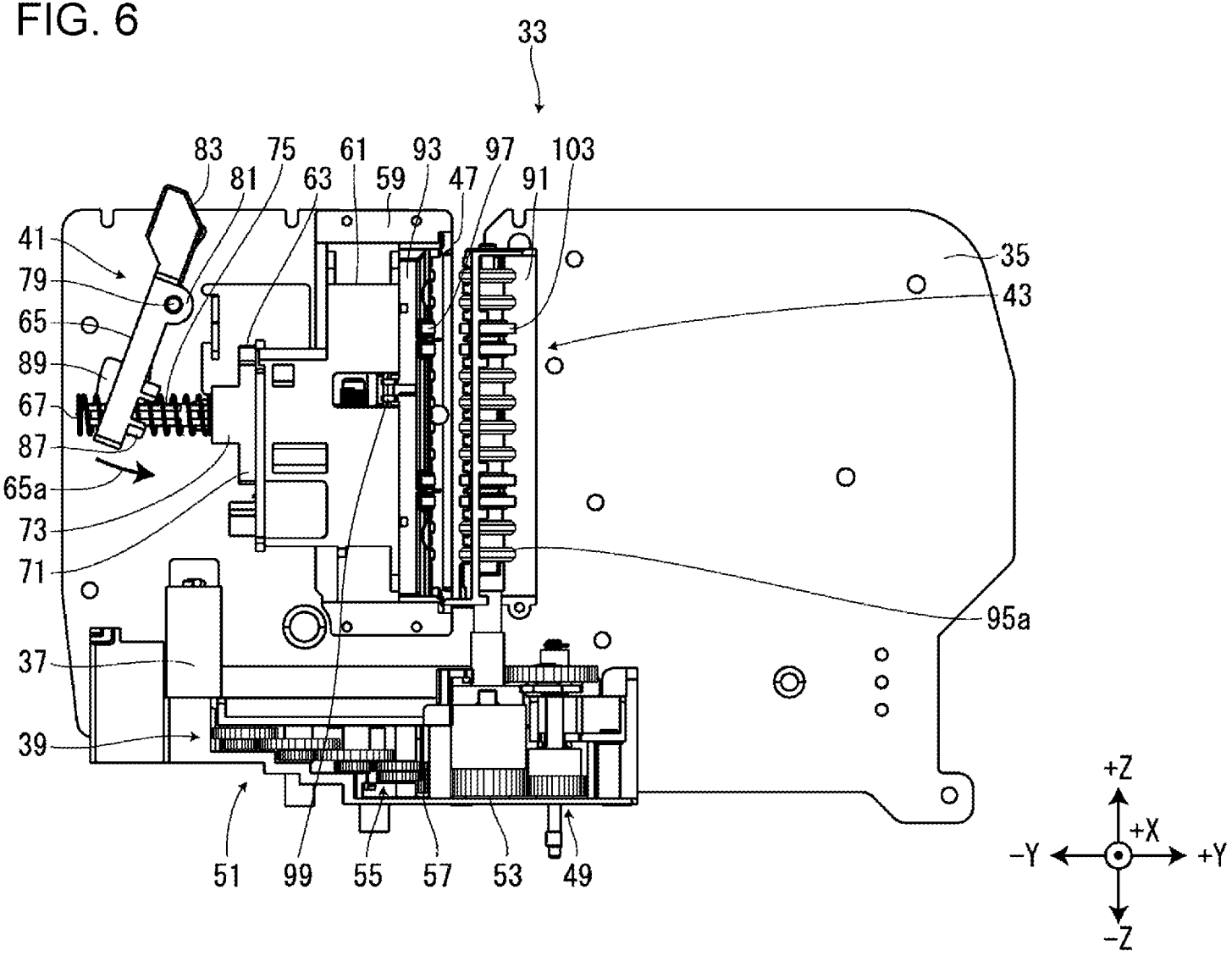
FIG. 6 is a view of the tape discharge unit when the mounting portion cover is opened as viewed from a +X side.
Figure 7:
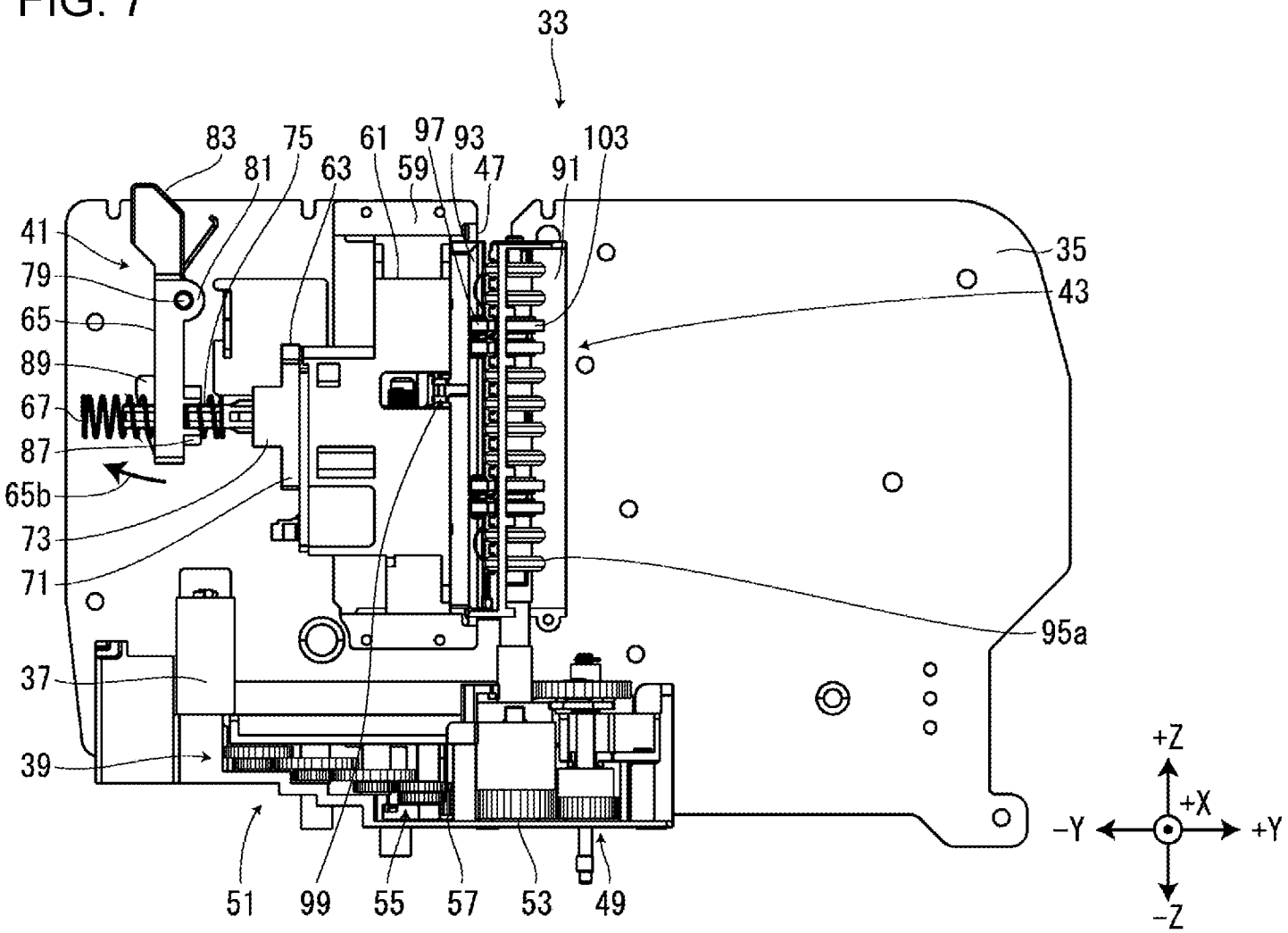
FIG. 7 is a view of the tape discharge unit when the mounting portion cover is closed as viewed from the +X side.

In the interlocking mechanism 41 configured in this manner, when the mounting portion cover 5 is closed, the interlocking lever 65 pivots in a lever first direction 65*a* while further compressing the pinching spring 67 to transition from the state illustrated in FIG. 6 to the state illustrated in FIG. 7 due to the interlocking protrusion 27 being engaged with the lever-side engaging inclined surface 83. At this time, the interlocking block 63, the sensor substrate 149, the sliding member 61, and the movable holder 93 are pushed to the +Y side by the interlocking lever 65 via the pinching spring 67. Accordingly, since the second discharge roller 95*b* and the third discharge rollers 95*c* which are supported by the movable holder 93 approach the first discharge roller 95*a*, it becomes possible to pinch the tape 213 between the first discharge roller 95*a*, the second discharge roller 95*b*, and the third discharge rollers 95*c*. The lever first direction 65*a* means a counterclockwise direction as viewed from the +X side.

Meanwhile, when the mounting portion cover 5 is opened, the interlocking lever 65 is caused by the pinching spring 67 to pivot in a lever second direction 65*b* which is the opposite direction from the lever first direction 65*a* to transition from the state illustrated in FIG. 7 to the state illustrated in FIG. 6 due to the interlocking protrusion 27 separating from the lever-side engaging inclined surface 83. At this time, due to the lever-side engaging portion 89 pushing the rod-side engaging portion 77 to the −Y side, the interlocking block 63, the sensor substrate 149, the sliding member 61, and the movable holder 93 are pulled back to the −Y side. Accordingly, since the second discharge roller 95*b* and the third discharge rollers 95*c* which are supported by the movable holder 93 separate from the first discharge roller 95*a*, it is possible to easily insert the tape 213 between the first discharge roller 95*a*, the second discharge roller 95*b*, and the third discharge rollers 95*c* during the mounting of the tape cartridge 201. The lever second direction 65*b* means a clockwise direction as viewed from the +X side.

Figure 8:
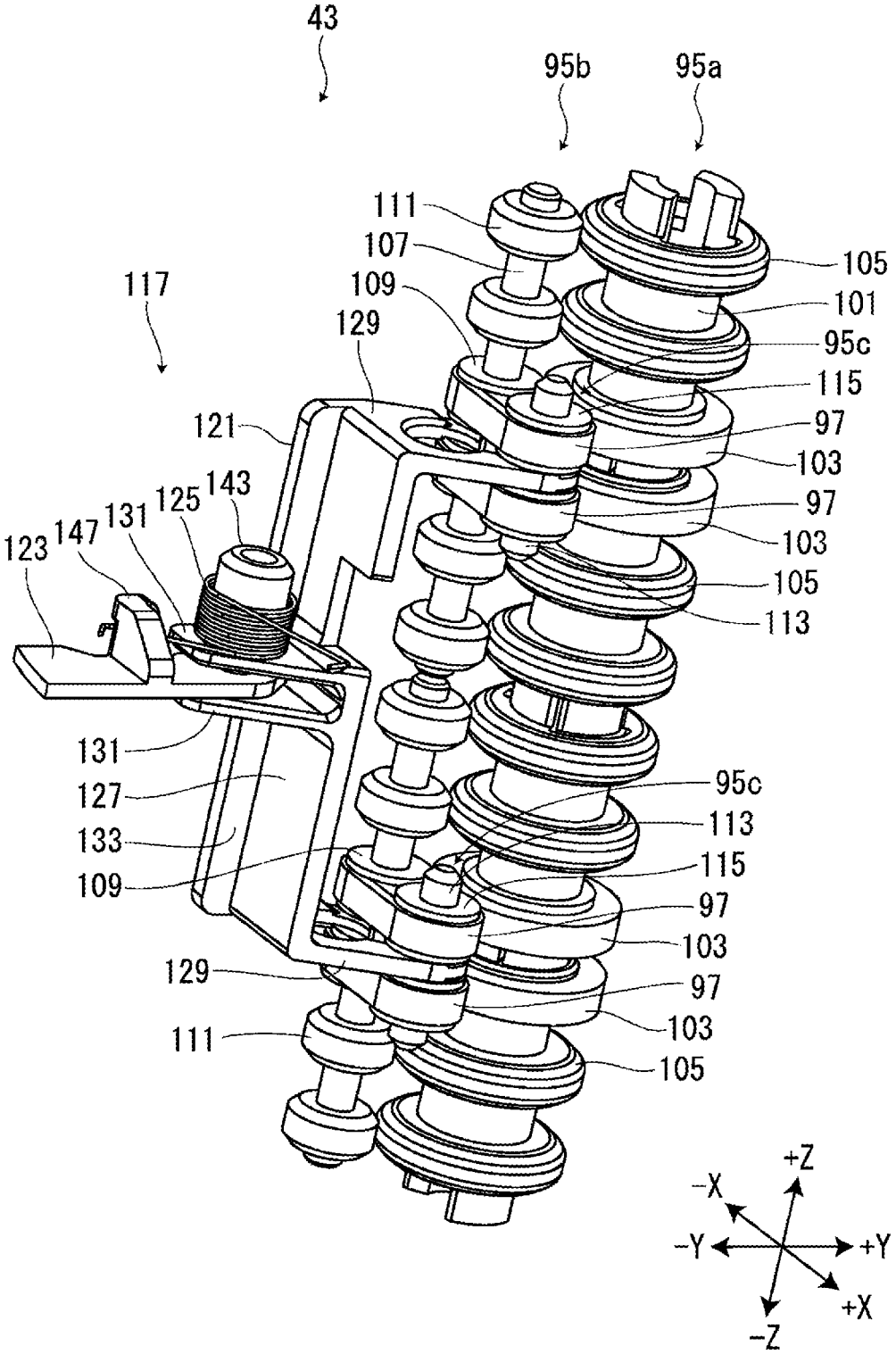
FIG. 8 is a perspective view of an discharge roller and a pivoting section.
Figure 9:
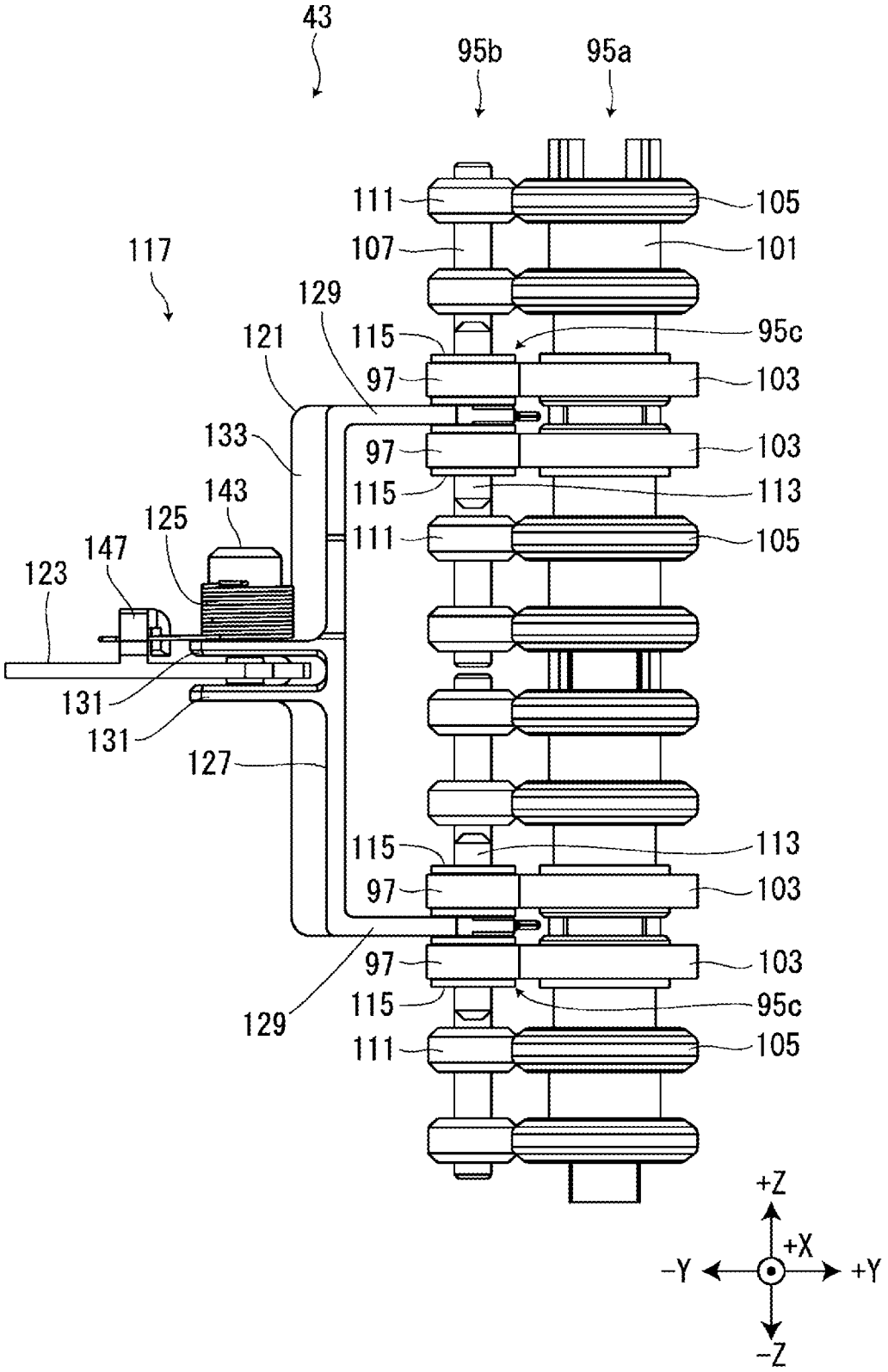
FIG. 9 is a view of the discharge roller and the pivoting section as viewed from the +X side.

The discharge feeding section 43 feeds the tape 213 dispensed from the tape feed-out port 215 of the tape cartridge 201 mounted to the cartridge mounting portion 7 toward the tape discharge port 19. The discharge feeding section 43 is provided with a fixed holder 91, the movable holder 93, and the first discharge roller 95*a*, as illustrated in FIGS. 4 and 5. As illustrated in FIGS. 8 and 9, the discharge feeding section 43 is provided with the second discharge roller 95*b*, two of the third discharge rollers 95*c*, and four discharge belts 97. When there is no particular necessity to distinguish between the first discharge roller 95*a*, the second discharge roller 95*b*, and the third discharge rollers 95*c*, they will simply be referred to as the discharge rollers 95.

The fixed holder 91 is fixed to the +Y side of the tape passage port 47. Meanwhile, the movable holder 93 is attached to the +Y side of the sliding member 61 supported by the slide support portion 59 to be capable of sliding in the Y directions. A holder-side spring locking portion 99 is provided on the movable holder 93 at a substantially middle portion in the Z directions of the −Y side.

As illustrated in FIGS. 8 and 9, the first discharge roller 95*a* is provided with a first discharge roller shaft 101 extending in the Z directions, four first belt roller portions 103 formed in substantially circular plate shapes, and eight first non-belt roller portions 105 formed in substantially circular plate shapes.

The first discharge roller shaft 101 is supported by the fixed holder 91 to be capable of rotating. The first discharge roller shaft 101 is joined to the roller gear 53 (refer to FIG. 4) provided on the same shaft. The first belt roller portions 103 and the first non-belt roller portions 105 are fixed to the first discharge roller shaft 101 and rotate integrally with the first discharge roller shaft 101. The four first belt roller portions 103 are provided distributed into two pairs in the axial directions, that is, the Z directions of the first discharge roller shaft 101. In other words, two of the first non-belt roller portions 105, one pair of the first belt roller portions 103, four of the first non-belt roller portions 105, one pair of the first belt roller portions 103, and two of the first non-belt roller portions 105 are provided in this order from the +Z side. The first belt roller portions 103 pinch the tape 213 between the first belt roller portions 103 and the discharge belts 97 (described later). The first non-belt roller portions 105 pinch the tape 213 between the first non-belt roller portions 105 and second dividing roller portions 111 (described later).

The second discharge roller 95*b* is provided close to the −X side of the −Y side with respect to the first discharge roller 95*a* and rotates to follow the first discharge roller 95*a*. The second discharge roller 95*b* is provided with a second discharge roller shaft 107 extending in the Z directions, four second pulley portions 109 formed in substantially circular plate shapes, and eight of the second dividing roller portions 111 formed in substantially circular plate shapes.

The second discharge roller shaft 107 is supported by the movable holder 93 to be capable of rotating. The second pulley portions 109 and the second dividing roller portions 111 are fixed to the second discharge roller shaft 107 and rotate integrally with the second discharge roller shaft 107. The four second pulley portions 109 are provided at positions corresponding to the four first belt roller portions 103 in the axial directions, that is, the Z directions of the second discharge roller shaft 107. In other words, the four second pulley portions 109 are provided distributed into two pairs in the Z directions in the same manner as the four first belt roller portions 103. The discharge belts 97 span the spaces between the second pulley portions 109 and third pulley portions 115 (described later). The eight second dividing roller portions 111 are provided at positions corresponding to the eight first non-belt roller portions 105 in the axial directions of the second discharge roller shaft 107. The second dividing roller portions 111 pinch the tape 213 between the second dividing roller portions 111 and the first non-belt roller portions 105.

The two third discharge rollers 95*c* are provided close to the +X side of the −Y side with respect to the first discharge roller 95*a*, that is, of the +X side of the second discharge roller 95*b* and rotate to follow the first discharge roller 95*a*. The two third discharge rollers 95*c* are provided at positions in the Z directions corresponding to the second pulley portions 109 provided distributed into two pairs in the Z directions. Each of the third discharge rollers 95*c* is provided with a third discharge roller shaft 113 extending in the Z directions and one pair of the third pulley portions 115 formed in substantially circular plate shapes. The third discharge roller shaft 113 is supported by the movable holder 93 to be capable of rotating. The third pulley portions 115 are fixed to the third discharge roller shaft 113 and rotate integrally with the third discharge roller shaft 113. The discharge belts 97 span the spaces between the third pulley portions 115 and second pulley portions 109.

The discharge belts 97 span the spaces between the second pulley portions 109 and the third pulley portions 115 and follow the first discharge roller 95*a* to run between the second pulley portions 109 and the third pulley portions 115. The discharge belts 97 are configured by a material having high friction properties and elasticity such as rubber, for example. The discharge belts 97 are provided at positions corresponding to the first belt roller portions 103 in the Z directions. In other words, the four discharge belts 97 are provided distributed into two pairs in the Z directions. The four discharge belts 97 are provided to run approximately parallel to an XY plane. The discharge belts 97 pinch the tape 213 between the discharge belts 97 and the first belt roller portion 103.

As described above, the movable holder 93 which supports the second discharge roller 95*b* and the third discharge rollers 95*c* is pushed toward the +Y side, that is, toward the first discharge roller 95*a* by the pinching spring 67. The discharge belts 97 support first belt roller portions 103 and the tape 213 in a range between the +Y side of the second pulley portions 109 and the +Y side of the third pulley portions 115 as viewed from the Z direction. Therefore, the +Y sides of the discharge belts 97 flex in a concave arc-shape to conform to the outer peripheral surfaces of the first belt roller portions 103. A range in which the tape 213 is pinched between the first belt roller portions 103 and the discharge belts 97 in the tape feeding direction, that is, the X directions in which the tape 213 is fed is referred to as a pinching range A. In the pinching range A, when the tape 213 is not present between the first belt roller portions 103 and the discharge belts 97, the first belt roller portions 103 and the discharge belts 97 are in contact with each other.

In the discharge feeding section 43 configured in this manner, when the feed motor 153 or the discharge motor 37 operates and the first discharge roller 95*a* rotates, the second discharge roller 95*b* and the third discharge rollers 95*c* rotate following the first discharge roller 95*a* and the discharge belts 97 run. Accordingly, the tape 213 which is pinched between the first belt roller portions 103 and the discharge belts 97 and between the first non-belt roller portions 105 and the second dividing roller portions 111 is fed toward the tape discharge port 19.

A plurality of types of the tape cartridge 201 are prepared to have different widths of the tape 213, different feeding positions of the tape 213, or the like. Regardless of which tape 213 of which tape cartridge 201 is used, the tape 213 is at least pinched between the pair of first belt roller portions 103 and the pair of discharge belts 97 of the +Z side or between the pair of first belt roller portions 103 and the pair of discharge belts 97 of the −Z side. In other words, due to the two sets of the first belt roller portions 103 and the two sets of the discharge belts 97 being provided distributed between two locations in the Z directions, it is possible to handle differences in the width and differences in the feeding position in the Z directions of the tape 213. The interval of the pair of first belt roller portions 103 in each set and the interval of the pair of discharge belts 97 in each set are narrower than the width of the tape 213 having the narrowest width. Therefore, even the tape 213 having the narrowest width is pinched between the pair of first belt roller portions 103 and the pair of discharge belts 97.

The tape detection mechanism 45 detects the presence or absence of the tape 213 between the discharge rollers 95, that is, between the first discharge roller 95*a*, the second discharge roller 95*b*, and the third discharge rollers 95*c*. The tape detection mechanism 45 is provided with a pivoting section 117 and an discharge sensor 119.

The pivoting section 117 pivots about the third discharge roller shaft 113 as the tape 213, which is fed thereto, comes into contact with the pivoting section 117. As illustrated in FIGS. 8 and 9, the pivoting section 117 is provided with a first pivoting member 121, the second pivoting member 123, and a pivoting spring 125.

Figure 14:
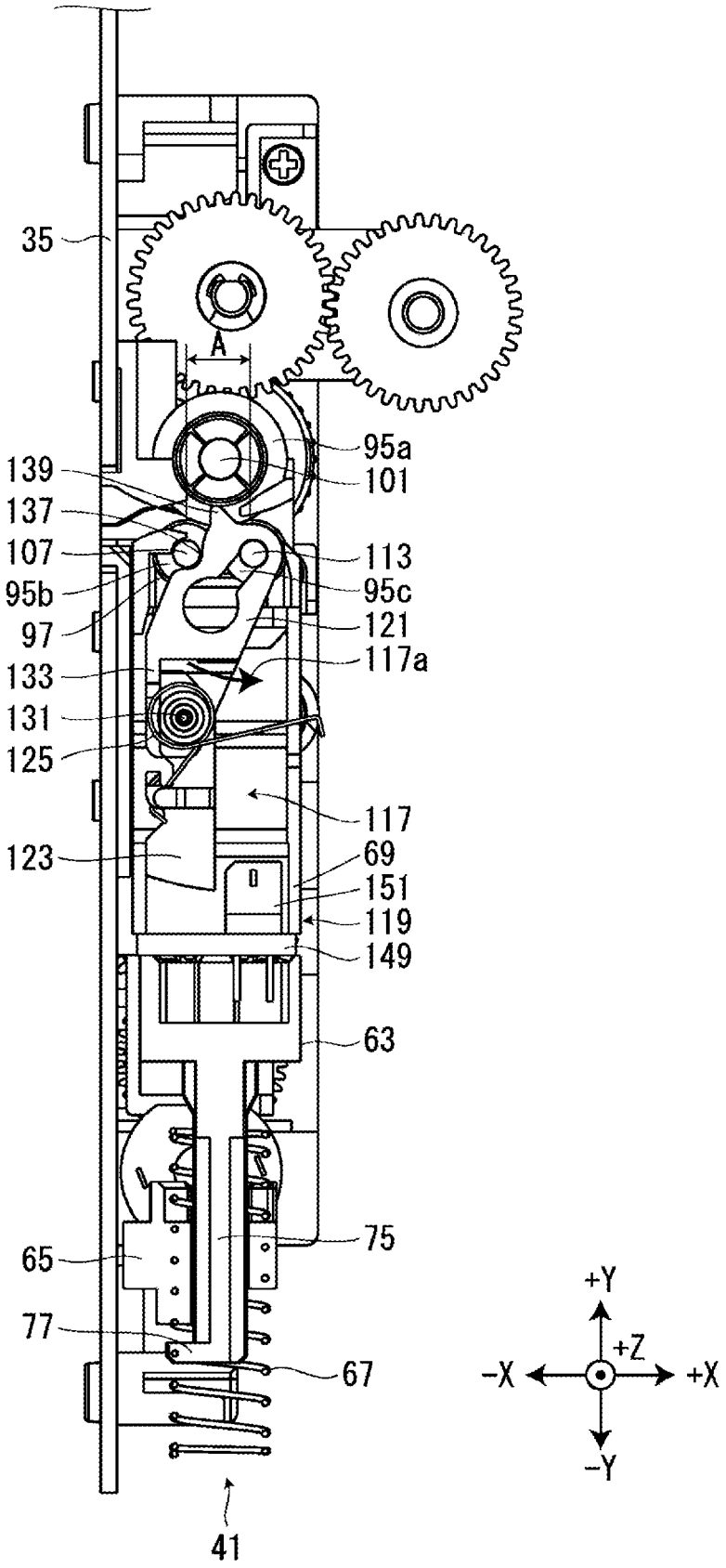
FIG. 14 is a view for explaining the movement of the first pivoting member and the second pivoting member.
Figure 15:
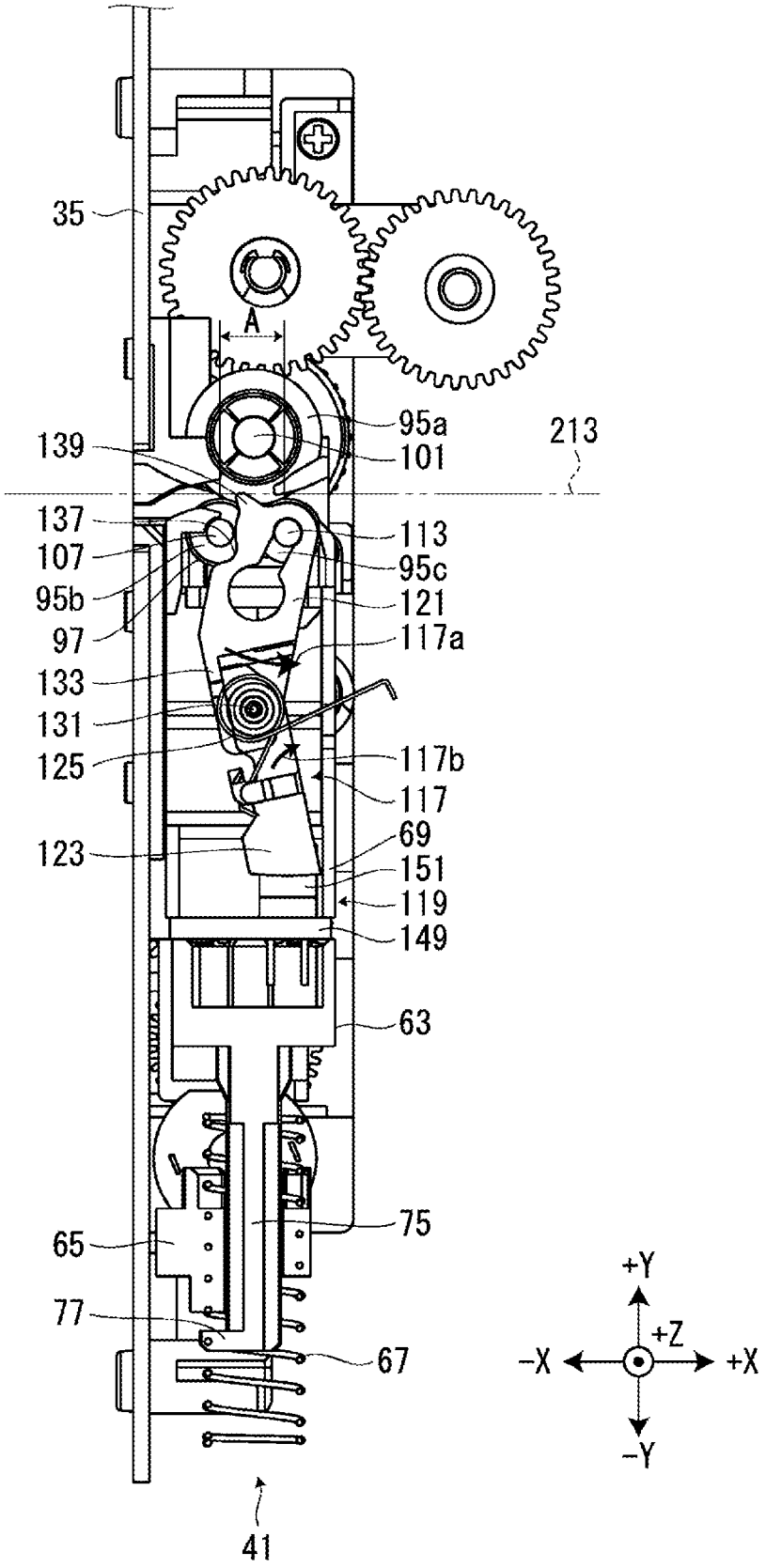
FIG. 15 is a view for explaining the movement of the first pivoting member and the second pivoting member continuing from FIG. 14.
Figure 16:
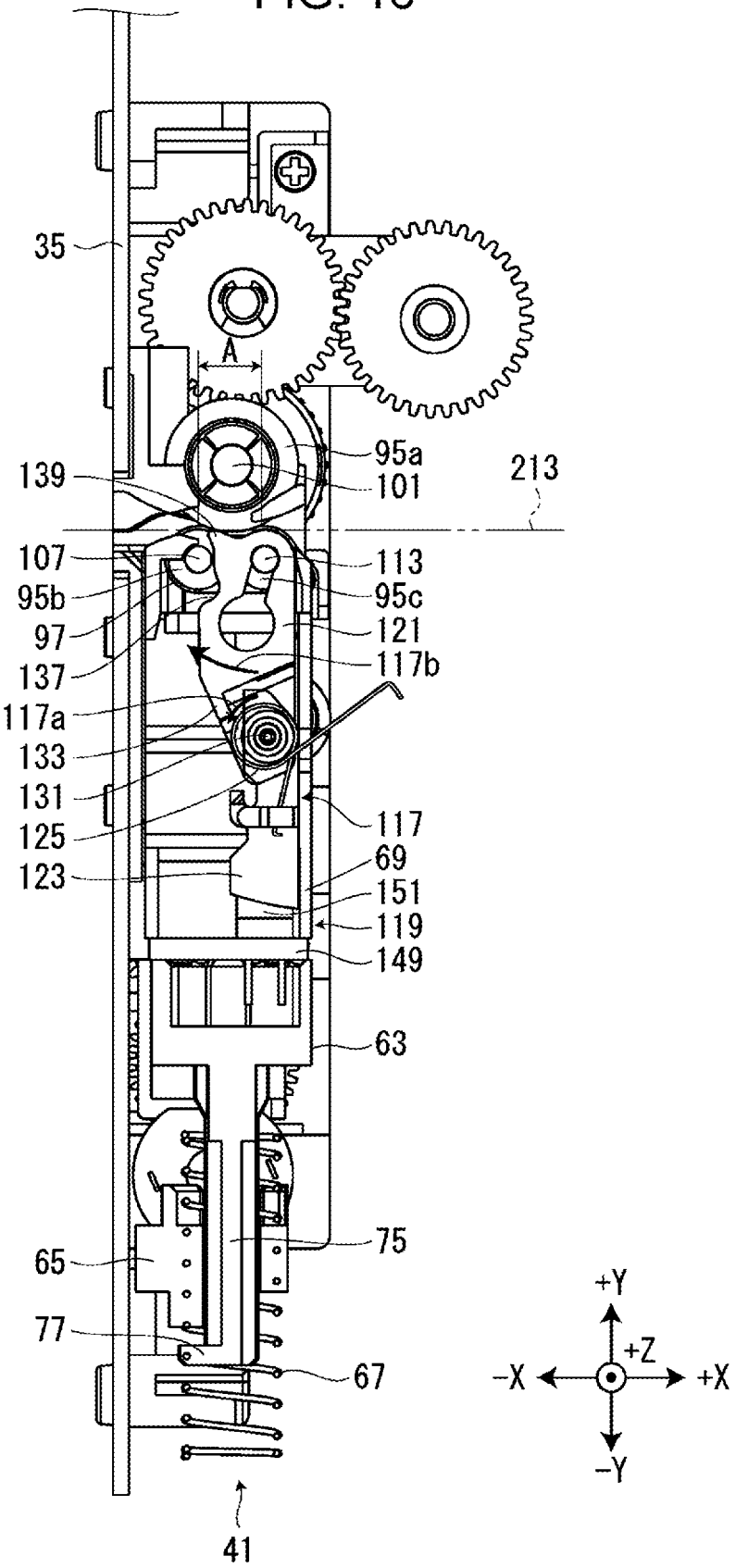
FIG. 16 is a view for explaining the movement of the first pivoting member and the second pivoting member continuing from FIG. 15.

As illustrated in FIGS. 14 to 16, the first pivoting member 121 is supported by the third discharge roller shaft 113 to be capable of pivoting. In other words, the first pivoting member 121 pivots about the third discharge roller shaft 113. The first pivoting member 121 is provided with a connection portion 127, two roller shaft insertion portions 129, two pivot linking portions 131, and a pivot restriction portion 133. The connection portion 127 is formed in a substantially rectangular plate-shape which is long in the Z directions and connects the two roller shaft insertion portions 129. The third discharge roller shaft 113 is an example of a "detection pivoting shaft".

The two roller shaft insertion portions 129 both protrude to the +Y side from both end portions of the connection portion 127 in the Z directions. One of the roller shaft insertion portions 129 is positioned between the pair of third pulley portions 115 provided on the third discharge roller 95*c* of the +Z side and the other of the roller shaft insertion portions 129 is positioned between the pair of third pulley portions 115 provided on the third discharge roller 95*c* of the −Z side.

Figure 10:
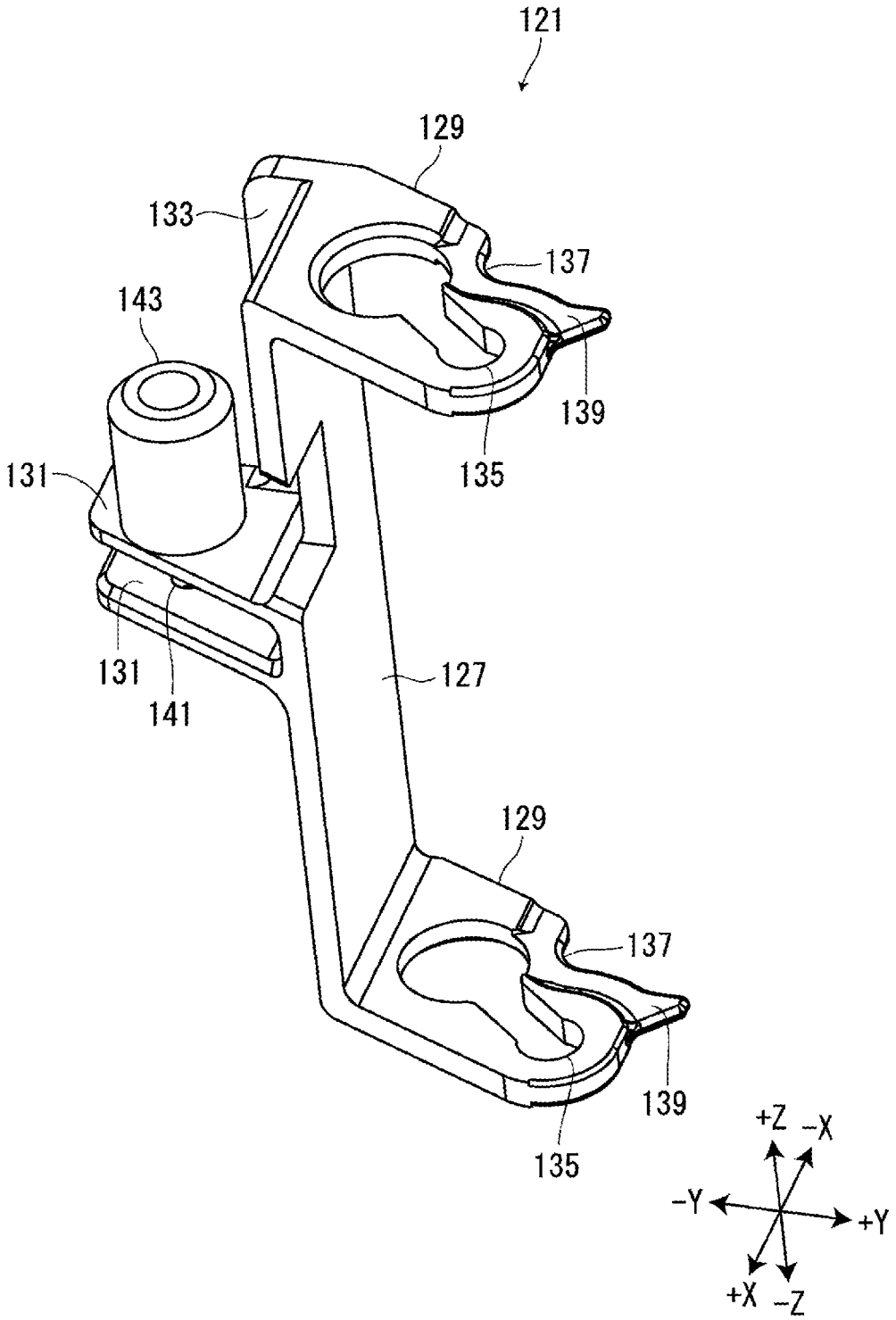
FIG. 10 is a perspective view of a first pivoting member.
Figure 11:
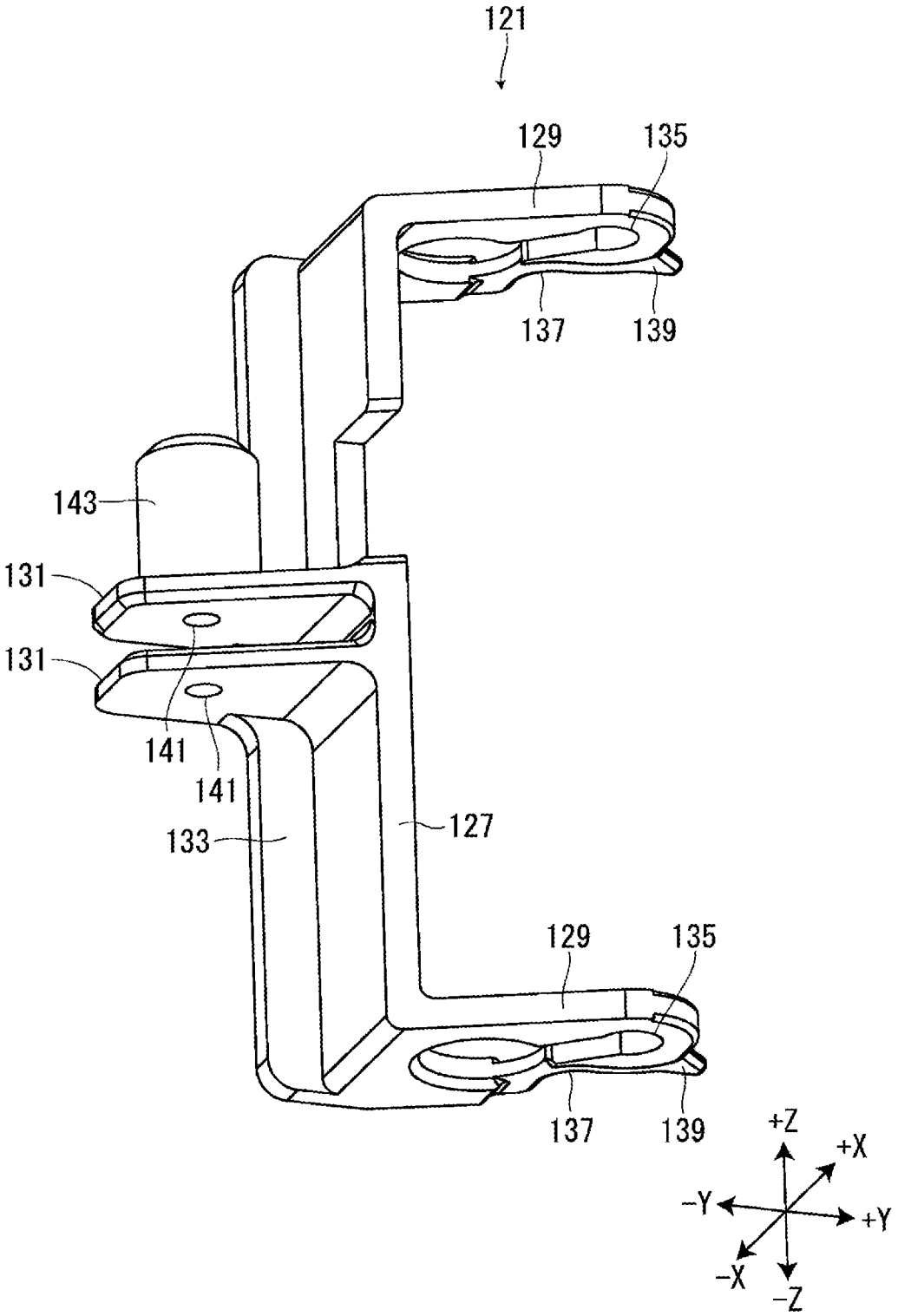
FIG. 11 is a perspective view of the first pivoting member from a different angle.

As illustrated in FIGS. 10 and 11, shaft insertion holes 135 through which the third discharge roller shaft 113 is inserted are provided in the roller shaft insertion portion 129. Pivoting recessed portions 137 which are recessed to the +X side are provided on the end portion of the roller shaft insertion portion 129 of the −X side. As described later, the pivoting recessed portions 137 come into contact with the second discharge roller shaft 107. A tape contact portion 139 protruding in a substantially triangular shape is provided on the leading end of the roller shaft insertion portion 129. The tape 213 fed between the discharge rollers 95 comes into contact with the tape contact portion 139. The tape contact portion 139 provided on the roller shaft insertion portion 129 of the +Z side is provided between the pair of discharge belts 97 of the +Z side and the tape contact portion 139 provided on the roller shaft insertion portion 129 of the −Z side is provided between the pair of discharge belts 97 of the −Z side. As illustrated in FIG. 15, the tape contact portion 139 comes into contact with the tape 213 inside the pinching range A in the tape feeding direction, that is, the X directions in which the tape 213 is fed.

Due to the two tape contact portions 139 being provided distributed between two locations in the Z directions in the same manner as the two sets of the first belt roller portions 103 and the two sets of the discharge belts 97, it is possible to handle differences in the width and differences in the feeding position in the Z directions of the tape 213. The first pivoting member 121 pivots if the tape 213 comes into contact with at least one of the two tape contact portions 139.

The two pivot linking portions 131 are provided to protrude to the −Y side from a substantially middle portion in the Z directions of the connection portion 127 and are in close proximity to each other in the Z directions. The second pivoting member 123 is joined to the two pivot linking portions 131 to be capable of pivoting such that the end portion of the +Y side of the second pivoting member 123 is interposed between the two pivot linking portions 131. Each of the two pivot linking portions 131 is provided with a pivot linking hole 141 into which a pivot linking shaft 145 (described later) fits. A spring mounting protrusion portion 143 is provided on the pivot linking portion 131 of the +Z side to protrude in a substantially columnar shape to the +Z side. The pivoting spring 125 is mounted to the spring mounting protrusion portion 143. The pivot restriction portion 133 protrudes to the −Y side along the edge portion of the connection portion 127 of the −X side. As described later, the end portion of the +Y side of the second pivoting member 123 comes into contact with the pivot restriction portion 133.

Figure 12:
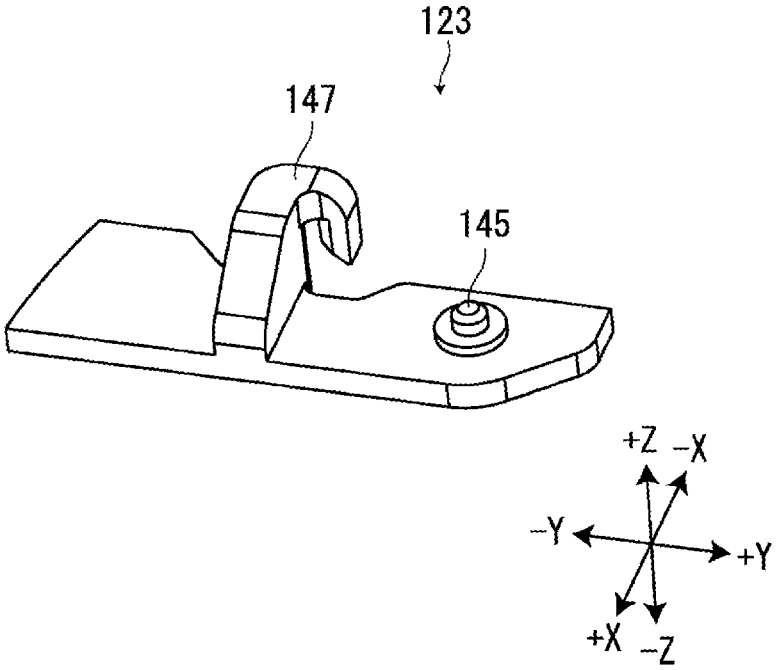
FIG. 12 is a perspective view of a second pivoting member.
Figure 13:
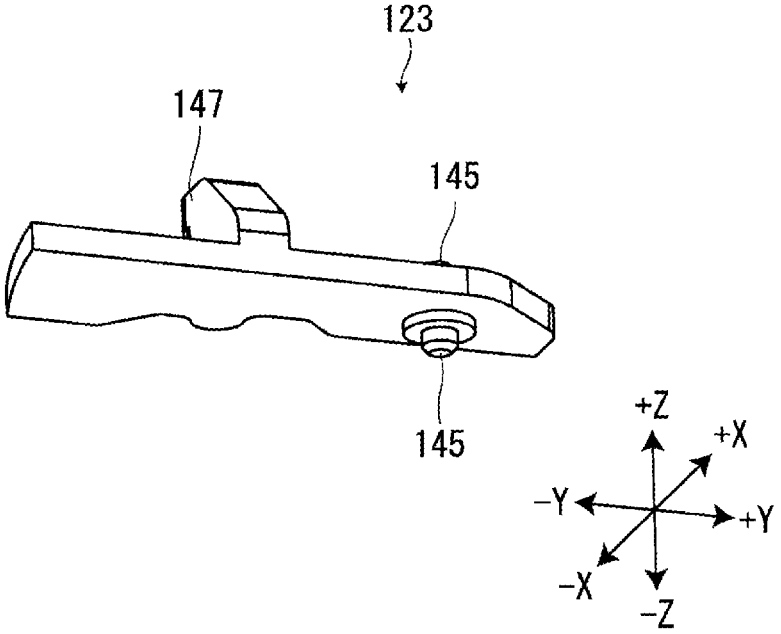
FIG. 13 is a perspective view of the second pivoting member as viewed from a different angle.

As illustrated in FIGS. 8 and 9, the second pivoting member 123 is formed in a substantially rectangular plate shape which is long in the Y directions and is joined to the first pivoting member 121 to be capable of pivoting. The second pivoting member 123 is provided with the pivot linking shafts 145 (refer to FIGS. 12 and 13) and a pivot-side spring locking portion 147. The pivot linking shafts 145 are provided on the end portion of the +Y side of the second pivoting member 123 and protrude to the +Z side and the −Z side, respectively. The pivot-side spring locking portion 147 is provided at substantially the middle portion of the second pivoting member 123 in the Y directions and protrudes in a hooked shape to the +Z side.

The pivoting spring 125 is mounted on the spring mounting protrusion portion 143, one end is locked to the holder-side spring locking portion 99 (refer to FIG. 5) and the other end is locked to the pivot-side spring locking portion 147. It is possible to use a torsion coil spring as the pivoting spring 125, for example. As illustrated in FIG. 16, the pivoting spring 125 applies a force to the first pivoting member 121 in a second pivoting direction 117*b* about the third discharge roller shaft 113. When the first pivoting member 121 is considered to be fixed, the pivoting spring 125 applies a force to the second pivoting member 123 in a first pivoting direction 117*a* which is the opposite direction from the second pivoting direction 117*b* about the pivot linking shafts 145. Here, the first pivoting direction 117*a* means a counterclockwise direction as viewed from the +Z side. Here, the second pivoting direction 117*b* means a clockwise direction as viewed from the +Z side. The pivoting spring 125 is an example of a "pivoting elastic member".

As illustrated in FIG. 5, the discharge sensor 119 is provided with the sensor substrate 149 and a sensor main body 151. The sensor substrate 149 is fixed between the sliding member 61 and the interlocking block 63 (refer to FIG. 4). The sensor main body 151 is attached to the +Y side of the sensor substrate 149. A light-emitting element and a light-receiving element (not illustrated) are embedded in the sensor main body 151. As illustrated in FIGS. 15 and 16, the sensor main body 151 is provided such that the end portion of the −Y side of the second pivoting member 123 is positioned between the light-emitting element and the light-receiving element when the second pivoting member 123 is in contact with the pivoting contact section 69. Although the discharge sensor 119 outputs a Low signal when a detection light emitted by the light-emitting element is received by the light-receiving element and outputs a High signal when the detection light emitted from the light-emitting element is not received by the light-receiving element, the reverse configuration may be adopted.

As illustrated in FIG. 14, in the tape detection mechanism 45 configured in this manner, the tape contact portion 139 protrudes toward the first discharge roller 95*a* when the tape 213 is not present between the discharge rollers 95. At this time, since the end portion of the −Y side of the second pivoting member 123 is not positioned between the light-emitting element and the light-receiving element and the detection light emitted from the light-emitting element is not received by the light-receiving element, the discharge sensor 119 outputs the Low signal to a control section 161.

As the printing process is started and the tape 213, which is fed from the tape cartridge 201, comes into contact with the tape contact portion 139, the first pivoting member 121 and the second pivoting member 123 rotate integrally in the first pivoting direction 117*a* against the pivoting spring 125 about the third discharge roller shaft 113 from the state illustrated in FIG. 14. Accordingly, the end portion of the −Y side of the second pivoting member 123 comes into contact with the pivoting contact section 69 and the state illustrated in FIG. 15 is assumed. At this time, in the discharge sensor 119, since the end portion of the −Y side of the second pivoting member 123 is positioned between the light-emitting element and the light-receiving element and the detection light emitted from the light-emitting element is not received by the light-receiving element, the High signal is output to the control section 161.

When the thickness of the tape 213 is comparatively thin, the tape 213 is fed still in the state illustrated in FIG. 15, and when the thickness of the tape 213 is comparatively thick, the first pivoting member 121 pivots further in the first pivoting direction 117*a* such that the first pivoting member 121 bends around at the pivot linking portions 131 with respect to the second pivoting member 123 from the state illustrated in FIG. 15 and assumes the state illustrated in FIG. 16. At this time, with regard to the second pivoting member 123, since the end portion of the −Y side comes into contact with the pivoting contact section 69 and the end portion of the +Y side is pushed to the +X side by the first pivoting member 121, the second pivoting member 123 pivots in the second pivoting direction 117*b* about the end portion of the −Y side which is in contact with the pivoting contact section 69. As a result, as may be understood by comparing FIGS. 14 and 16, the pivoting amount of the second pivoting member 123 about the third discharge roller shaft 113 is small as compared to the pivoting amount of the first pivoting member 121 about the third discharge roller shaft 113. At this time, in the discharge sensor 119, since the end portion of the −Y side of the second pivoting member 123 is still positioned between the light-emitting element and the light-receiving element, the High signal is output to the control section 161.

Due to the pivoting spring 125 being provided on the pivot linking portions 131, the direction in which the second pivoting member 123 pivots and the direction of the load placed on the second pivoting member 123 by the pivoting spring 125 approximately match. Therefore, fluctuations in the magnitude of the load placed on the second pivoting member 123 by the pivoting spring 125 are suppressed. Accordingly, it is possible to cause the second pivoting member 123 to smoothly pivot in the second pivoting direction 117*b* against the pivoting spring 125 after the second pivoting member 123 comes into contact with the pivoting contact section 69.

When the tape 213 passes between the discharge rollers 95 from the state illustrated in FIG. 16, the first pivoting member 121 and the second pivoting member 123 return to the state illustrated in FIG. 14. In other words, due to the pivoting spring 125, the first pivoting member 121 pivots in the second pivoting direction 117*b* about the third discharge roller shaft 113 and the second pivoting member 123 pivots in the first pivoting direction 117*a* about the pivot linking portions 131.

The first pivoting member 121 pivots in the second pivoting direction 117*b* until the pivoting recessed portions 137 come into contact with the second discharge roller shaft 107. In other words, the second discharge roller shaft 107 restricts the range in which the first pivoting member 121 pivots in the second pivoting direction 117*b*. The second pivoting member 123 pivots in the first pivoting direction 117*a* until the end portion of the +Y side of the second pivoting member 123 comes into contact with the pivot restriction portion 133. In other words, the pivot restriction portion 133 restricts the range in which the second pivoting member 123 pivots in the first pivoting direction 117*a*.

As described above, according to the tape printing apparatus 1 of the present embodiment, due to the tape 213 being pinched between the first belt roller portions 103 and the discharge belts 97, the tape 213 is pinched over a wider range in the length directions of the tape 213 as compared to the tape 213 being pinched between the first non-belt roller portions 105 and the second dividing roller portions 111. Accordingly, since the tape 213 is firmly pinched, the deformation of the tape 213 is suppressed by the tape contact portion 139 of the first pivoting member 121 to which the force of the pivoting spring 125 is applied in the second pivoting direction 117*b*. Therefore, when the tape 213 is present between the first belt roller portions 103 and the discharge belts 97, it is possible to cause the first pivoting member 121 to pivot appropriately in the first pivoting direction 117*a* against the pivoting spring 125 and it is possible to suppress the erroneous detection of the tape 213 not being present between the first belt roller portions 103 and the discharge belts 97. Since the pinching range A widens in the tape feeding direction as compared to a configuration in which the tape 213 is pinched between one roller and another, even if the position of the tape contact portion 139 shifts a little in the tape feeding direction, it is possible to cause the tape contact portion 139 to contact the tape 213 within the pinching range A. Accordingly, it is possible to appropriately detect the presence or absence of the tape 213 within the pinching range A, that is, whether or not the tape 213 is discharged when the discharge rollers 95 are caused to rotate.

According to the tape printing apparatus 1 of the present embodiment, due to the first pivoting member 121 and the second pivoting member 123 being interlocked with each other to be capable of pivoting, it is possible to reduce the pivoting amount of the second pivoting member 123 about the third discharge roller shaft 113 as compared to the pivoting amount of the first pivoting member 121 about the third discharge roller shaft 113. Therefore, even when the thickness of the tape 213 which is fed is thick and the first pivoting member 121 pivots greatly, the pivoting amount of the second pivoting member 123 is suppressed. Therefore, it is not necessary to secure a large space for the second pivoting member 123 to pivot and it is possible to reduce the size of the tape discharge unit 33.

Configuration between Print Head and Tape Output Port

Figure 17:
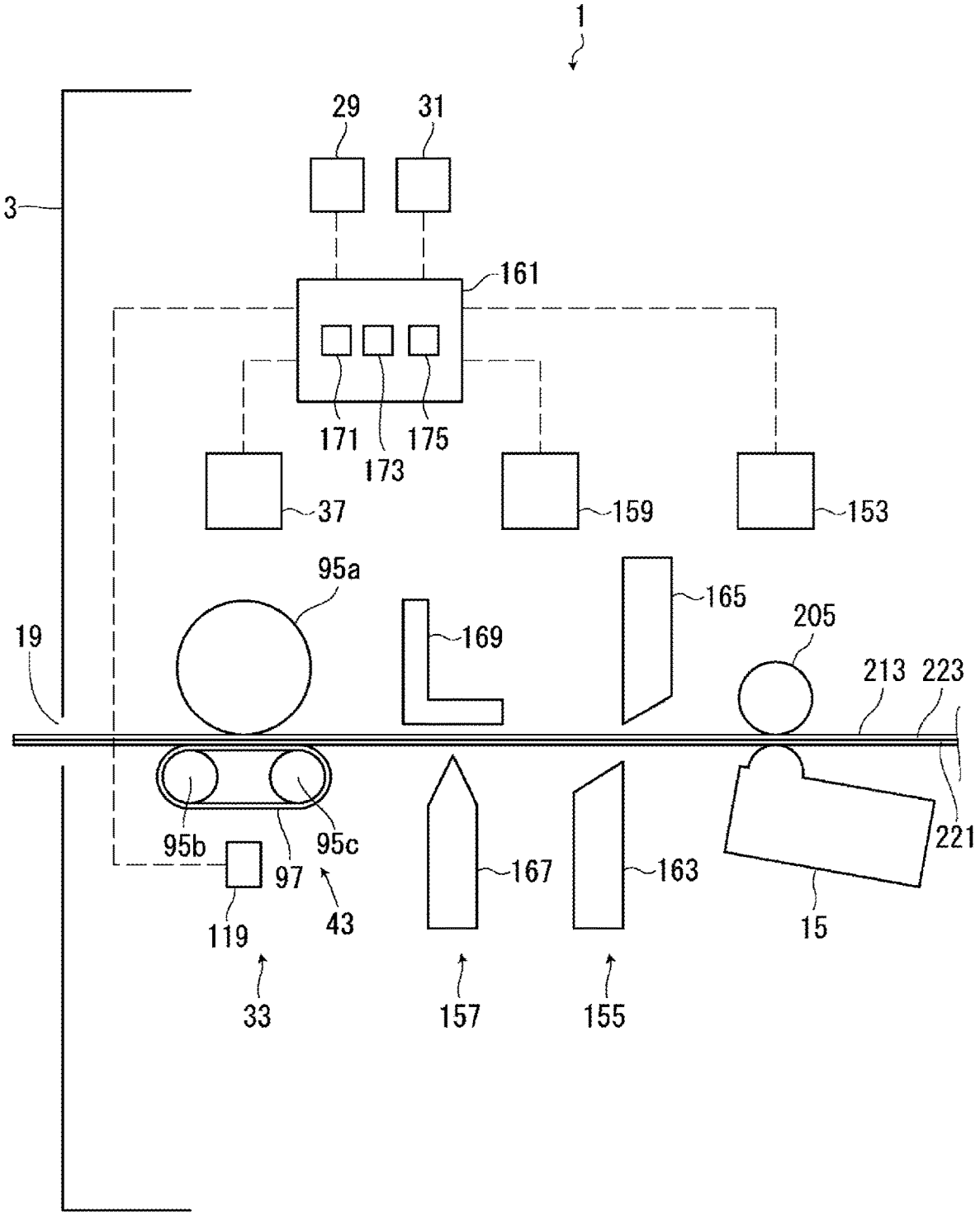
FIG. 17 is a view illustrating a configuration of a print head and a tape discharge port.

As illustrated in FIG. 17, the full cutter 155, the half cutter 157, and the tape discharge unit 33 are provided between the print head 15 and the tape discharge port 19 in this order from the print head 15 side. The tape printing apparatus 1 is provided with the feed motor 153, a cutter motor 159, and the control section 161.

The feed motor 153 is the drive source of the platen roller 205. As described above, the feed motor 153 is also the drive source of the discharge rollers 95. The full cutter 155 is provided with a movable blade 163 and a fixed blade 165 and performs a full cut of the tape 213, that is, cuts both the printing tape 221 and the peeling tape 223 due to the movable blade 163 cutting into the fixed blade 165.

The half cutter 157 performs a half cut on the tape 213, that is, cuts the printing tape 221 without cutting the peeling tape 223. A cut 225 (refer to FIG. 18) is formed in the printing tape 221 due to the half cutter 157 performing the half cut. The half cutter 157 is provided with a cutting blade 167 and a blade receiving member 169. The half cutter 157 performs a blade closing operation in which the tape 213 is half cut by the cutting blade 167 cutting into the blade receiving member 169 and a blade opening operation in which the cutting blade 167 cut into the blade receiving member 169 separates from the blade receiving member 169. The half cutter 157 may be configured to cut the peeling tape 223 without cutting the printing tape 221.

The cutter motor 159 is the drive source of the full cutter 155 and the half cutter 157. The cutter motor 159 separately drives the full cutter 155 and the half cutter 157 by changing the rotation direction, for example. Here, the rotation direction of the cutter motor 159 which drives the full cutter 155 will be referred to as a full direction and the rotation direction of the cutter motor 159 which drives the half cutter 157 will be referred to as a half direction. The tape printing apparatus 1 may be configured to separately include a motor that drives the full cutter 155 and a motor that drives the half cutter 157.

The control section 161 performs overall control of various parts of the tape printing apparatus 1 such as the feed motor 153, the cutter motor 159, and the discharge motor 37. The control section 161 is provided with a processor 171 represented by a central processing unit (CPU) and various kinds of memory such as random access memory 173 (RAM) and read only memory 175 (ROM). The processor 171 reads a control program stored in the ROM 175 and executes the control program using the RAM 173.

Here, for example, when the specification such as the thickness or the material of the tape 213 is different from that of a genuine product, there is a concern that the half cutter 157 may cut not only the printing tape 221 but also the peeling tape 223. Therefore, during the printing, the control section 161 executes the print control process described hereinafter. Hereinafter, both the printing tape 221 and the peeling tape 223 being cut by the half cutter 157 will be referred to as miscutting of the tape 213.

Print Control Process

Figure 19:
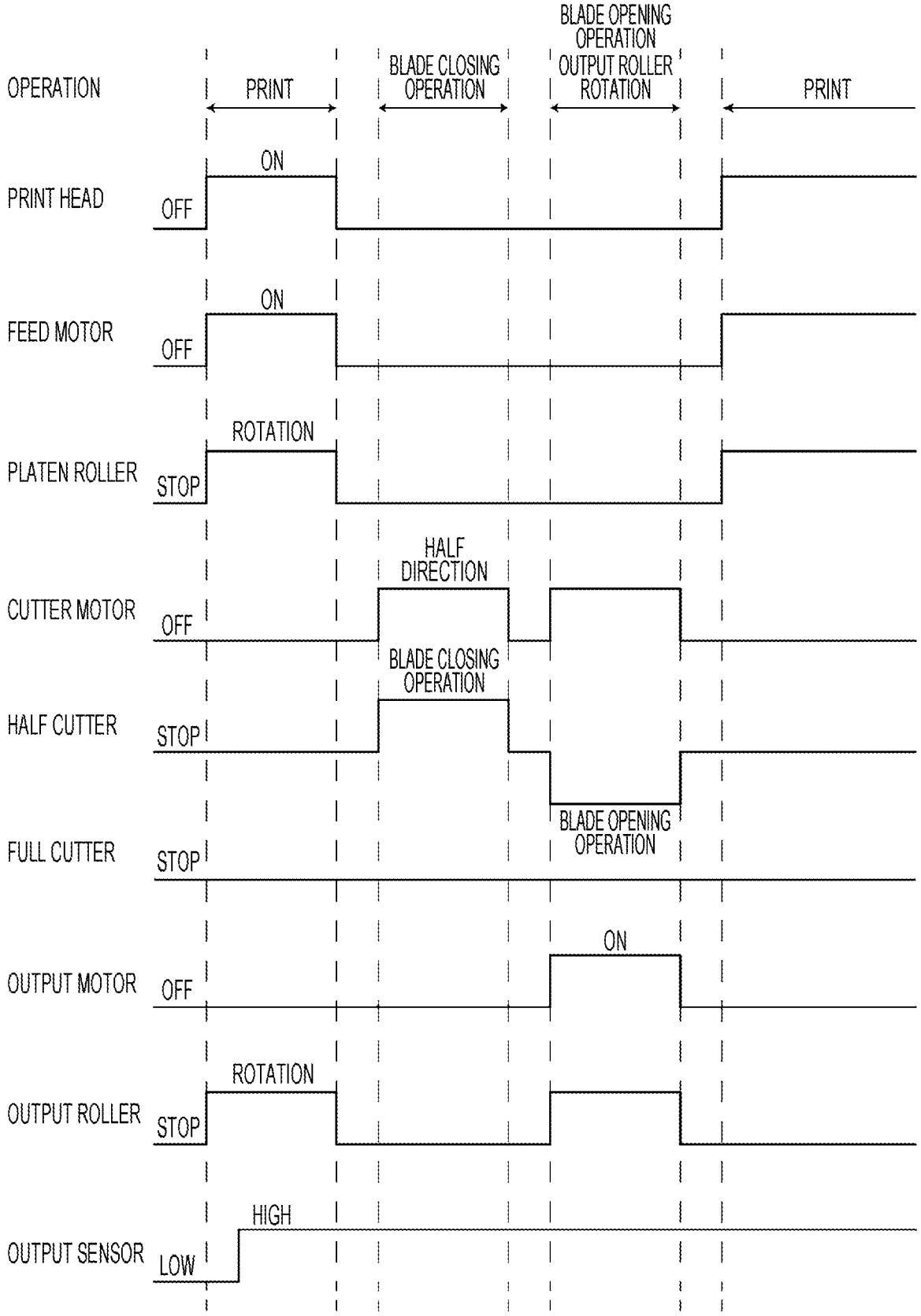
FIG. 19 is a time chart of a case in which half cutting is performed appropriately by the half cutter in a print control process.

A description will be given of the print control process which is executed by the control section 161 during the printing based on FIG. 19 with reference to FIG. 17. Here, it is assumed that the tape 213 is cut by the full cutter 155 in the previous print control process. Therefore, the leading end of the tape 213 is positioned at the full cutter 155. In the following print control process, although the processor 171 is realized by executing the control program, the processor 171 may be realized using only hardware resources.

First, when the control section 161 receives a print execution command from the keyboard 29 or the like, the control section 161 drives the feed motor 153 and the print head 15. Accordingly, the platen roller 205 and the discharge rollers 95 rotate, the tape 213 is fed, the print head 15 emits heat, and the printing starts. When the tape 213 which is fed comes into contact with the tape contact portion 139, the discharge sensor 119 outputs the High signal.

Next, when the half cut location of the tape 213 reaches the half cutter 157, the control section 161 stops the driving of the feed motor 153 and the print head 15. Accordingly, since the rotation of the platen roller 205 and the discharge rollers 95 stops, the feeding of the tape 213 stops, and the print head 15 stops emitting heat, the printing is canceled.

Next, the control section 161 drives the cutter motor 159 in the half direction. Accordingly, the half cutter 157 performs the blade closing operation. here, it is assumed that the tape 213 is not miscut and the half cutting is performed appropriately.

After driving the cutter motor 159 a predetermined amount, the control section 161 stops the driving of the cutter motor 159, and after a predetermined time elapses, the control section 161 drives the cutter motor 159 in the half direction again. Accordingly, the half cutter 157 performs the blade opening operation. At this time, the control section 161 drives the discharge motor 37. Accordingly, the discharge rollers 95 rotate without the platen roller 205 rotating. Here, since the tape 213 is not miscut by the half cutter 157 and the tape 213 is continuous between the discharge rollers 95 and the platen roller 205, even if the discharge rollers 95 rotate, the tape 213 pinched between the platen roller 205 and the print head 15 is not discharged from the tape discharge port 19. Therefore, the detection signal of the discharge sensor 119 remains the High signal.

After driving the cutter motor 159 by a predetermined amount, the control section 161 stops the driving of the cutter motor 159 and the discharge motor 37. When the detection signal from the discharge sensor 119 remains the High signal while the control section 161 drives the cutter motor 159 and the discharge motor 37, the control section 161 determines that the tape 213 is not miscut by the half cutter 157, and after stopping the driving of the cutter motor 159 and the discharge motor 37, drives the feed motor 153 and the print head 15 and restarts the printing. When all of the printing is completed, although not illustrated in FIG. 19, the control section 161 drives the cutter motor 159 in the full direction, cuts the tape 213 using the full cutter 155, drives the discharge motor 37 to discharge the tape 213 which is cut off from the tape discharge port 19 using the discharge rollers 95, and subsequently completes the print control process.

Figure 20:
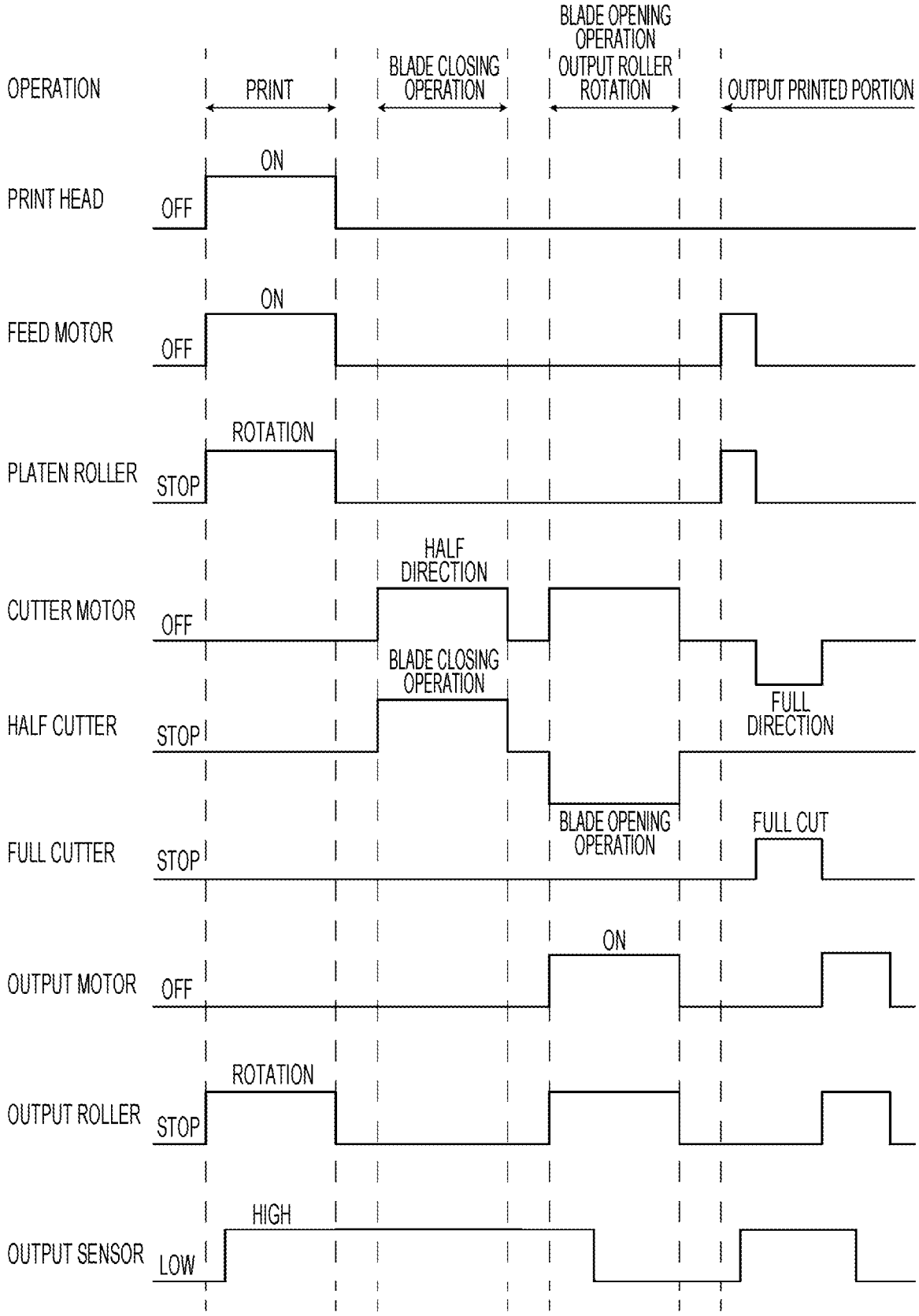
FIG. 20 is a time chart of a case in which the tape is miscut by the half cutter in the print control process.

Meanwhile, a description will be given of a case in which the tape 213 is miscut when the half cutter 157 performs the blade closing operation based on FIG. 20. In this case, when the discharge rollers 95 rotate during the blade opening operation, the portion of the tape 213 that is cut off by the half cutter 157 is discharged from the tape discharge port 19. As a result, the detection signal of the discharge sensor 119 switches from the High signal to the Low signal.

When the detection signal of the discharge sensor 119 switches to the Low signal during the driving of the cutter motor 159 and the discharge motor 37, the control section 161 determines that the tape 213 is miscut by the half cutter 157. In this case, after stopping the driving of the cutter motor 159 and the discharge motor 37, instead of restarting the printing, the control section 161 drives the feed motor 153 in order to discharge the printed portion of the tape 213 which is printed part way. Once the rear end of the printed portion of the tape 213 reaches the full cutter 155, the control section 161 stops the driving of the feed motor 153 and drives the cutter motor 159 in the full direction. Accordingly, the full cutter 155 cuts the tape 213. Next, the control section 161 drives the discharge motor 37. Accordingly, the printed portion of the tape 213 which is cut off is discharged from the tape discharge port 19.

When the control section 161 determines that the tape 213 is miscut by the half cutter 157, the control section 161 may end the print control process without driving the feed motor 153, the cutter motor 159, and the discharge motor 37. When the control section 161 determines that the tape 213 is miscut by the half cutter 157, the control section 161 may cause a notification section such as the display 31 to perform an error notification that the half cutting was not performed appropriately.

As described above, according to the tape printing apparatus 1 of the present embodiment, due to the discharge rollers 95 rotating during the blade opening operation of the half cutter 157, when the tape 213 is not miscut by the half cutter 157, the tape 213 is not discharged, and when the tape 213 is miscut by the half cutter 157, the tape 213 which is cut off is discharged. Therefore, different detection signals are output by the discharge sensor 119 between a case in which the tape 213 is not miscut by the half cutter 157 and a case in which the tape 213 is miscut by the half cutter 157. Therefore, it is possible to detect whether or not the tape 213 is miscut by the half cutter 157. When it is detected that the tape 213 is miscut by the half cutter 157, it is possible to perform adjustment such as weakening the cut-in force of the cutting blade 167 with respect to the blade receiving member 169, for example. Accordingly, it is possible to suppress the tape 213 being miscut again during the next blade closing operation.

Other Modification Examples

The present disclosure is not limited to the embodiment described above, and it goes without saying that various configurations may be adopted within a scope that does not depart from the gist of the present disclosure. For example, in addition to the above description, the embodiment may be modified in the following modes.

The configuration is not limited to one in which the tape detection mechanism 45 is provided in the tape discharge unit 33 and may be a configuration in which the tape detection mechanism 45 is provided between the print head 15 and the full cutter 155, for example. In other words, a configuration may be adopted in which the tape detection mechanism 45 detects the presence or absence of the tape 213 between the print head 15 and the full cutter 155, for example.

Instead of the pivoting spring 125, a configuration may be adopted including two elastic members, an elastic member which causes the first pivoting member 121 to pivot in the second pivoting direction 117*b* and an elastic member which causes the second pivoting member 123 to pivot in the first pivoting direction 117*a*. Naturally, by using the single pivoting spring 125 as in the embodiment, it is possible to improve the assembling properties of the pivoting section 117 as compared to a configuration provided with two elastic members.

The discharge sensor 119 is not limited to a transmitting type and may be a reflecting type. The discharge sensor 119 is not limited to an optical system and may use a mechanical switch such as a micro-switch, for example. Naturally, by using an optical system as in the embodiment, the sensor applying a load to the pivoting of the first pivoting member 121 and the second pivoting member 123 is suppressed and it is possible to cause the first pivoting member 121 and the second pivoting member 123 to pivot smoothly.

The first pivoting member 121 is not limited to a configuration in which the first pivoting member 121 pivots about the third discharge roller shaft 113 and may be configured to pivot about the second discharge roller shaft 107, for example.

The discharge rollers 95 are not limited to a configuration in which the discharge rollers 95 rotate during the blade opening operation of the half cutter 157 and may be configured to rotate after the start of the blade opening operation and before the start of the rotation of the platen roller 205. Even in this configuration, it is possible to detect the presence or absence of miscutting by the half cutter 157 before restarting the printing. Naturally, due to the discharge rollers 95 rotating during the blade opening operation of the half cutter 157 as in the embodiment, it is possible to immediately restart the printing after the completion of the blade opening operation.

The cartridge mounting portion 7 is not limited to a configuration in which the tape cartridge 201 or the ribbon cartridge is selectively mounted to the cartridge mounting portion 7, and may be configured such that only the tape cartridge 201 is mounted or configured such that only the ribbon cartridge is mounted. The tape 213 is not limited to a configuration in which the tape 213 is supplied from the tape cartridge 201 mounted to the cartridge mounting portion 7 and may be configured to be supplied from outside of the tape printing apparatus 1 as in the case of the ribbon cartridge being mounted.

A configuration may be adopted in which the embodiment and modification examples are combined with each other.

APPENDIX

Hereinafter, an appendix will be given relating to the tape detection mechanism and the tape printing apparatus.

A tape detection mechanism includes a first pivoting member provided to pivot about a detection pivoting shaft, a second pivoting member pivotally linked to a pivot linking portion provided on the first pivoting member, a pivoting contact section with which the second pivoting member comes into contact when the first pivoting member and the second pivoting member pivot in a first pivoting direction about the detection pivoting shaft as the tape, which is fed thereto, comes into contact with the first pivoting member, and a sensor which detects the second pivoting member which comes into contact with the pivoting contact section.

In this configuration, due to the first pivoting member and the second pivoting member being interlocked with each other to be capable of pivoting, it is possible to reduce the pivoting amount of the second pivoting member about the detection pivoting shaft as compared to the pivoting amount of the first pivoting member about the detection pivoting shaft. Therefore, even when the thickness of the tape which is fed is thick and the first pivoting member pivots greatly, the pivoting amount of the second pivoting member is suppressed. Therefore, it is not necessary to secure a large space for the second pivoting member to pivot and it is possible to reduce the size of the tape detection mechanism.

In this case, it is preferable for the tape detection mechanism to further include a pivoting elastic member which applies a force to the first pivoting member such that the first pivoting member pivots in a second pivoting direction which is an opposite direction from the first pivoting direction about the detection pivoting shaft and applies a force to the second pivoting member such that the second pivoting member pivots in the first pivoting direction about the pivot linking portion.

In this configuration, after the tape passes through, it is possible to cause the first pivoting member to pivot in the second pivoting direction about the detection pivoting shaft and to cause the second pivoting member to pivot in the second pivoting direction about the pivot linking portion. Since it is not necessary to provide the two elastic members of the elastic member which applies a force to the first pivoting member in the second pivoting direction and the elastic member which applies a force to the second pivoting member in the first pivoting direction, it is possible to improve the assembling properties.

In this case, it is preferable for a pivot restriction portion which restricts a range in which the second pivoting member pivots to the first pivoting direction to be provided on the first pivoting member.

In this configuration, after the tape passes through, it is possible to cause the second pivoting member which pivots in the first pivoting direction to pivot to an appropriate position.

In this case, it is preferable for the pivoting elastic member to be provided on the pivot linking portion.

In this configuration, after the second pivoting member comes into contact with the pivoting contact section, when the second pivoting member pivots in the second pivoting direction with respect to the first pivoting member, fluctuations in the magnitude of the load applied to the second pivoting member by the pivoting elastic member are suppressed. Accordingly, it is possible to cause the second pivoting member to smoothly pivot in the second pivoting direction against the pivoting elastic member after the second pivoting member comes into contact with the pivoting contact section.

In this case, it is preferable for the sensor to use an optical system.

In this configuration, the sensor applying a load to the pivoting of the first pivoting member and the second pivoting member is suppressed and it is possible to cause the first pivoting member and the second pivoting member to pivot smoothly.

A tape printing apparatus including a first pivoting member provided to pivot about a detection pivoting shaft, a second pivoting member pivotally linked to a pivot linking portion provided on the first pivoting member, a pivoting contact section with which the second pivoting member comes into contact when the first pivoting member and the second pivoting member pivot in a first pivoting direction about the detection pivoting shaft as the tape, which is fed thereto, comes into contact with the first pivoting member, a sensor which detects the second pivoting member which comes into contact with the pivoting contact section, and a print head which performs printing on the tape.

In this configuration, due to the first pivoting member and the second pivoting member being interlocked with each other to be capable of pivoting, it is possible to reduce the pivoting amount of the second pivoting member about the detection pivoting shaft as compared to the pivoting amount of the first pivoting member about the detection pivoting shaft. Therefore, even when the thickness of the tape which is fed is thick and the first pivoting member pivots greatly, the pivoting amount of the second pivoting member is suppressed. Therefore, it is not necessary to secure a large space for the second pivoting member to pivot and it is possible to reduce the size of the tape detection mechanism.

What is claimed is:

1. A tape detection mechanism comprising:

a first pivoting member provided to pivot about a detection pivoting shaft;

a second pivoting member pivotably linked to a pivot linking portion provided on the first pivoting member;

a pivoting contact section with which the second pivoting member comes into contact when the first pivoting member and the second pivoting member pivot in a first pivoting direction about the detection pivoting shaft as the tape, which is fed thereto, comes into contact with the first pivoting member;

a sensor which detects the second pivoting member which comes into contact with the pivoting contact section; and a pivoting elastic member which applies a force to the first pivoting member such that the first pivoting member pivots in a second pivoting direction which is an opposite direction from the first pivoting direction about the detection pivoting shaft and applies a force to the second pivoting member such that the second pivoting member pivots in the first pivoting direction about the pivot linking portion.

2. The tape detection mechanism according to claim 1, wherein a pivot restriction portion which restricts a range in which the second pivoting member pivots to the first pivoting direction is provided on the first pivoting member.

3. The tape detection mechanism according to claim 1, wherein the pivoting elastic member is provided on the pivot linking portion.

4. The tape detection mechanism according to claim 1, wherein the sensor uses an optical system.

5. A tape printing apparatus comprising:

a first pivoting member provided to pivot about a detection pivoting shaft;

a second pivoting member pivotably linked to a pivot linking portion provided on the first pivoting member;

a pivoting contact section with which the second pivoting member comes into contact when the first pivoting member and the second pivoting member pivot in a first pivoting direction about the detection pivoting shaft as the tape, which is fed thereto, comes into contact with the first pivoting member;

a sensor which detects the second pivoting member which comes into contact with the pivoting contact section;

a print head which performs printing on the tape; and a pivoting elastic member which applies a force to the first pivoting member such that the first pivoting member pivots in a second pivoting direction which is an opposite direction from the first pivoting direction about the detection pivoting shaft and applies a force to the second pivoting member such that the second pivoting member pivots in the first pivoting direction about the pivot linking portion.

* * * * *